US006992055B1

(12) United States Patent
Nitta et al.

(10) Patent No.: US 6,992,055 B1
(45) Date of Patent: Jan. 31, 2006

(54) PROCESS FOR PREPARING DETERGENT COMPOSITIONS HAVING HIGH BULK DENSITY

(75) Inventors: Hideichi Nitta, Wakayama (JP); Hiroyuki Yamashita, Wakayama (JP); Jun Saito, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/254,474

(22) PCT Filed: Sep. 3, 1997

(86) PCT No.: PCT/JP97/03095

§ 371 (c)(1),
(2), (4) Date: Mar. 5, 1999

(87) PCT Pub. No.: WO98/10052

PCT Pub. Date: Mar. 12, 1998

(30) Foreign Application Priority Data

Sep. 6, 1996 (JP) ..... 8-257416

(51) Int. Cl.
*C11D 11/00* (2006.01)

(52) U.S. Cl. ..... 510/444; 510/441; 510/357; 510/495

(58) Field of Classification Search ..... 510/444, 510/441, 442, 495, 357
See application file for complete search history.

(56) References Cited

U.S. PATENT DOCUMENTS

| | | | | | |
|---|---|---|---|---|---|
| 2,688,035 | A | * | 8/1954 | Jacob et al. | 562/97 |
| 3,425,948 | A | * | 2/1969 | Otrhalek et al. | 510/455 |
| 4,153,625 | A | * | 5/1979 | Barton et al. | 558/31 |
| 4,515,707 | A | * | 5/1985 | Brooks | 510/294 |
| 4,734,224 | A | * | 3/1988 | Barrett et al. | 510/357 |
| 4,919,847 | A | | 4/1990 | Barletta et al. | 510/442 |
| 5,486,317 | A | * | 1/1996 | Dorset et al. | 510/444 |
| 5,490,954 | A | * | 2/1996 | Van der Hoeven et al. | 510/536 |
| 5,527,489 | A | * | 6/1996 | Tadsen et al. | 510/294 |
| 5,573,697 | A | * | 11/1996 | Riddick et al. | 510/359 |
| 5,576,285 | A | * | 11/1996 | France et al. | 510/444 |
| 5,633,224 | A | | 5/1997 | Porter | 510/444 |
| 5,703,037 | A | * | 12/1997 | Doumen et al. | 510/444 |

FOREIGN PATENT DOCUMENTS

| | | | |
|---|---|---|---|
| EP | 0352135 | A1 * | 1/1990 |
| EP | 0 353976 | * | 2/1990 |
| EP | 0 420 317 | * | 4/1991 |
| EP | 0420317 | A1 * | 4/1991 |
| EP | 0 555 622 | * | 8/1993 |
| GB | 1369269 | | 10/1974 |
| JP | 229500 | | 1/1990 |
| JP | 8170100 | | 7/1996 |
| WO | 90 01536 | * | 2/1990 |
| WO | 93 235 20 | * | 11/1993 |
| WO | 94 07990 | * | 4/1994 |
| WO | 96 04359 | * | 2/1996 |
| WO | WO 97/32002 | A1 * | 9/1997 |
| WO | 99 00 475 | * | 1/1999 |

* cited by examiner

*Primary Examiner*—Lorna M. Douyon
(74) *Attorney, Agent, or Firm*—Birch, Stewart, Kolasch & Birch, LLP

(57) ABSTRACT

A method for producing detergent granules, includes the step of dry-neutralizing a liquid acid precursor of a non-soap, anionic surfactant with a water-soluble, solid, alkali inorganic substance. In this method, a dry-neutralizing step is carried out in the presence of 0.1 to 1.0 mol of an inorganic acid per mol of the liquid acid precursor of a non-soap, anionic surfactant. The above detergent granules have the features of extremely low tackiness of the granules and containing larger number of micropores. By using the detergent granules, a high-bulk density detergent composition having a small particle size can be obtained at high yields.

10 Claims, 7 Drawing Sheets

PROCESS FOR PREPARING DETERGENT COMPOSITIONS HAVING HIGH BULK DENSITY

This application is the national phase under 35 U.S.C. §371 of prior PCT International Application No. PCT/JP97/03095 which has an International filing date of Sep. 3, 1997 which designated the United States of America.

TECHNICAL FIELD

The present invention relates to detergent granules comprising a non-soap, anionic surfactant and an inorganic salt. The present invention relates to a method for producing the above detergent granules by a dry-neutralization process. The present invention further relates to a high-bulk density detergent composition containing the above detergent granules.

BACKGROUND ART

In the detergent industries, recently, methods for producing powder detergents having relatively high bulk densities are remarked. Such powdery detergents containing anionic surfactants, such as alkylbenzenesulfonates, are prepared in situ neutralization of an acid precursor of the anionic surfactant with an alkali, such as sodium hydroxide, sodium carbonate, or the like.

For instance, Japanese Patent Laid-Open No. 60-72999 and GB-2,166,452B disclose a process comprising the steps water of blending deterging action components, a sulfonic acid and sodium carbonate, with water with a strong shearing device; cooling the resulting solid substances to 40° C. or lower; finely pulverizing the cooled product; and then forming the fine powders into granules. This method is a typical one of those conventionally proposed methods, in which the neutralization reaction product is a doughy mass, which necessitates a kneading device, such as a kneader, capable of supplying extremely large energy required for the neutralization reaction.

GB-1,369,269 discloses a method for producing an anionic detergent comprising vigorously mixing deterging action components which are a sulfonic acid and sodium carbonate powder by using a mixer equipped with a shearing device, such as Lödige PLOUGH SHARE Mixer. By this method, in order to obtain products of particulate forms, not a doughy mass, it is necessary to blow a gas stream into the two-component mixture mentioned above, to thereby suitably make the reaction substances flowable and blend the reaction mixture. In order to carry out this treatment, the mixer has to be made notably complicated. Also, since water serving to accelerate the neutralization reaction is not added, the progress of this reaction is mild, so that relatively coarse products are formed.

Japanese Patent Laid-Open No. 3-33199 discloses a method of producing a detergent composition comprising the steps of dry-neutralizing components in a high speed mixer/granulator at a temperature of 55° C. or less, and then adding a liquid binder thereto to carry out granulation. Japanese Patent Laid-Open No. 4-363398 discloses a method of producing a detergent composition comprising the steps of dry-neutralizing components in a high speed mixer/granulator at a temperature of 55° C. or more, and then adding a liquid binder thereto to carry out granulation. Japanese Patent Laid-Open No. 3-146599 discloses a method of producing a detergent composition comprising the steps of dry-neutralizing components in a continuous high speed mixer; then increasing to a high bulk density using a moderate speed mixer; and then cooling and/or drying the resulting product to carry out granulation.

The detergent compositions obtainable by the methods described above include granules having small particle sizes. However, for practical purposes, the yield of the detergent composition comprising granules of an even smaller particle size than those desired is yet to be improved.

Also, in the above methods, such factors in operating conditions as the powder temperature, the water content, the powder blending efficiency, and the like, are optimally selected simply for the purpose of preparing detergent compositions comprising granules having smaller particle sizes, never attempting to fundamentally improve the tackiness ascribed to the anionic surfactants, which causes agglomeration of the granules and formation of coarse granules.

Japanese Unexamined Patent Publication No. 7-503750 discloses a method of producing detergent granules comprising neutralizing an anionic surfactant in an acid form with a granular neutralizing agent (sodium carbonate) of which has 50% by volume of particles of less than 5 $\mu$m in diameter in a high shearing mixer.

However, in this publication, no disclosures or suggestions concerning the improvements of the yield of the detergent composition comprising granules having a desired particle size are made.

An object of the present invention is to provide detergent granules with suppressed tackiness and small particle size.

Another object of the present invention is to provide a method for producing the above detergent granules.

Still another object of the present invention is to provide a high-bulk density detergent composition comprising the above detergent granules.

These and other objects of the present invention will be apparent from the following description.

DISCLOSURE OF THE INVENTION

The present invention is concerned with the following:

(1) detergent granules comprising a non-soap, anionic surfactant and an inorganic salt undetectable by X-ray diffraction method, wherein the molar ratio of [inorganic salt undetectable by X-ray diffraction method]/[non-soap, anionic surfactant] is from 0.1 to 1.0;

(2) the detergent granules described in item (1) above, wherein the non-soap, anionic surfactant is contained in the detergent granules in an amount of 28% by weight or more and less than 50% by weight;

(3) the detergent granules described in item (1) above, wherein the non-soap, anionic surfactant is contained in the detergent granules in an amount of 10% by weight or more and less than 28% by weight, and wherein the molar ratio of [inorganic salt undetectable by X-ray diffraction method]/[non-soap, anionic surfactant] is from 0.3 to 1.0;

(4) a method for producing detergent granules, comprising the step of dry-neutralizing a liquid acid precursor of a non-soap, anionic surfactant with a water-soluble, solid, alkali inorganic substance, wherein a dry-neutralizing step is carried out in the presence of 0.1 to 1.0 mol of an inorganic acid per mol of the liquid acid precursor of a non-soap, anionic surfactant;

(5) the method described in item (4) above, further comprising the step of adding a free-flowing aid after the dry-neutralizing step, to surface-modify the detergent granules;

(6) the method described in item (4) above, further comprising the step of adding a liquid component after the dry-neutralizing step;

(7) the method described in item (6) above, further comprising the step of adding a free-flowing aid after the step of adding a liquid component, to surface-modify the detergent granules;

(8) the method described in any one of items (4) to (7) above, wherein the liquid acid precursor of a non-soap, anionic surfactant is a linear alkylbenzenesulfonic acid obtained by $SO_3$ gas sulfonation method;

(9) the method described in any one of items (4) to (8) above, wherein an amount of an inorganic acid preexisting in the liquid acid precursor of a non-soap, anionic surfactant is 0.09 mol or less per mol of the liquid acid precursor;

(10) the method described in any one of items (4) to (9) above, wherein the inorganic acid is sulfuric acid or phosphoric acid;

(11) the method described in any one of items (4) to (10) above, wherein the resulting detergent granules contain the non-soap, anionic surfactant in an amount of 28% by weight or more and less than 50% by weight, and have a molar ratio of [inorganic salt undetectable by X-ray diffraction method]/[non-soap, anionic surfactant] of from 0.1 to 1.0;

(12) the method described in any one of items (4) to (10) above, wherein the resulting detergent granules contain the non-soap, anionic surfactant in an amount of 10% by weight or more and less than 28% by weight in the detergent granules, and have a molar ratio of [inorganic salt undetectable by X-ray diffraction method]/[non-soap, anionic surfactant] of from 0.3 to 1.0; and

(13) a high-bulk density detergent composition having a bulk density of 500 g/L or more, comprising the detergent granules according to any one of items (1) to (3) above, or the detergent granules obtainable by the method of any one of items (4) to (12).

BEST MODE FOR CARRYING OUT THE INVENTION

Figure 1:
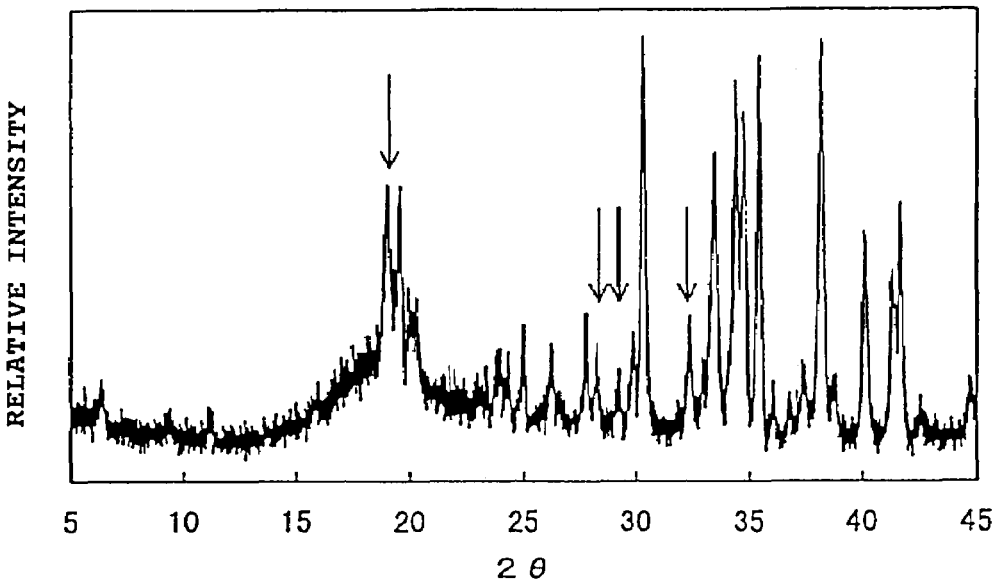
FIG. 1 is a graph showing X-ray diffraction patterns of the detergent granules obtained in Comparative Example 13. Its measurement is taken by X-ray diffraction analyzer "RAD-RC" (manufactured by Rigaku Co., Ltd.). In the figure, the arrows indicate the diffraction peaks of the powdery sodium sulfate.

The method for producing detergent granules of the present invention comprises the step of dry-neutralizing a liquid acid precursor of a non-soap, anionic surfactant with a water-soluble, solid, alkali inorganic substance, wherein a dry-neutralizing step is carried out in the presence of 0.1 to 1.0 mol of an inorganic acid per mol of the liquid acid precursor of a non-soap, anionic surfactant.

In the present invention, it is possible to produce detergent granules and high-bulk density detergent composition by the above method. In other words, since the granules, which are obtainable by the step of dry-neutralizing a liquid acid precursor of the non-soap, anionic surfactant with a water-soluble, solid, alkali inorganic substance in the intentional presence of an inorganic acid, comprise neutralized salts derived from the inorganic acids in relatively larger amounts at near the surfaces of the granules than at the inner portion of the granules, the resulting granules have low tackiness and small particle sizes. Also, since the tackiness of the granules can be suppressed, the granules with a high surfactant content can be obtained without causing agglomeration of the granules.

The embodiments of the dry-neutralization process in the method of the present invention are not particularly limited as long as the dry-neutralization process is carried out in the presence of a given amount of an inorganic acid. An embodiment includes, for instance, carrying out the dry-neutralization process comprising blending a mixture of a liquid acid precursor of a non-soap, anionic surfactant and an inorganic acid with a water-soluble, solid, alkali inorganic substance. The present invention will be further explained in detail below by taking the above embodiment as one example of the method of the present invention.

This embodiment comprises 1) a blending step and 2) a dry-neutralizing step. Each of the steps will be detailed below.

1) Blending Step

This process precedes the dry-neutralizing step and comprises blending a liquid acid precursor of a non-soap, anionic surfactant with an inorganic acid in advance.

The liquid acid precursors of non-soap, anionic surfactants refer to the precursors of the non-soap, anionic surfactants in the form of acids in a liquid state, which are formed into salts by neutralization reaction. Therefore, the liquid acid precursors of non-soap, anionic surfactants may be precursors having the above properties of any of known anionic surfactants acids without particular limitations. Concrete examples thereof include linear alkylbenzenesulfonic acids (LAS), α-olefin sulfonic acids (AOS), alkyl sulfuric acids (AS), and internal olefin sulfonic acids, sulfonic acids of fatty acid esters, alkylether sulfuric acids, dialkyl sulfosuccinic acids, and the like. The liquid acid precursors may be used singly or in a combination of two or more components.

The preferred inorganic acids usable in the present invention include sulfuric acid and phosphoric-acid. More preferred inorganic acid includes sulfuric acid. Also, there are some cases where remaining sulfuric acid is contained in the liquid acid precursor of a non-soap, anionic surfactant usable in the present invention by the production process of the liquid acid precursor.

The linear alkylbenzenesulfonates listed as the preferred liquid acid precursors of a non-soap, anionic surfactant may be prepared by one of the following two typical methods.

(1) Oleum sulfonation method.

(2) $SO_3$ gas sulfonation method.

(1) is a classical method for producing linear alkylbenzenesulfonic acids, wherein sulfuric acid may be contained in the resulting product in an amount of about 0.3 mol per mol of the linear alkylbenzenesulfonic acid. Also, in (2), the purity of the linear alkylbenzenesulfonic acids in the resulting product is high, and the amount of remaining sulfuric acid is relatively low, wherein the amount of remaining sulfuric acid is usually 0.2 mol or less per mol of the linear alkylbenzenesulfonic acid. Presently, from the aspects of quality and productivity, the method (2) is mainly employed as the method of giving high-purity linear alkylbenzenesulfonic acids. In the present invention, the linear alkylbenzenesulfonates prepared by (2) are preferably used.

As mentioned above, the inorganic acid may preexist in the precursors of non-soap, anionic surfactants in some cases. The amount of the inorganic acid, namely the amount of the inorganic acid preexisting in the liquid acid precursors of the non-soap, anionic surfactants, is not particularly limited. From the viewpoint of the hue in the resulting detergent granules, the amount of the inorganic acid is preferably 0.09 mol or less, more preferably 0.06 mol or less, per mol of the liquid acid precursor.

The amount of the inorganic acid in the method of the present invention is from 0.1 to 1.0 mol per mol of the liquid acid precursor of a non-soap, anionic surfactant, preferably from 0.1 to 0.8 mol, more preferably from 0.15 to 0.65 mol, still more preferably from 0.2 to 0.6 mol, still more preferably from 0.25 to 0.55 mol, per mol of the liquid acid precursor. From the viewpoint of inhibiting the formation of coarse granules of the detergent granules, the amount of the inorganic acid is preferably 0.1 mol or more, and from the viewpoint of securing the compositional freedom of the concentrated detergent, the amount of the inorganic acid is preferably 1.0 mol or less. In particular, from the viewpoint of the microporosity of the detergent granules as detailed below, the amount of the inorganic acid is preferably 0.3 mol or more, more preferably from 0.3 to 1.0 mol, still more preferably from 0.3 to 0.8 mol, still more preferably 0.35 to 0.7 mol, per mol of the precursor.

Also, as clearly described in Examples set forth below, by changing the ratios between the liquid acid precursor of a non-soap, anionic surfactant and the inorganic acid, the tackiness and/or microporosity of the resulting neutralized granules can be varied.

Therefore, the above ratio can be appropriately selected and adjusted by contents of the non-soap, anionic surfactant in the granules, kinds of inorganic acids used, differences in the additives employed, or the like.

In other words, it is desired that the inorganic acid is added to the starting material components, including the liquid acid precursor of a non-soap, anionic surfactant, in the case where the amount of the inorganic acid preexisting in the liquid acid precursor of a non-soap, anionic surfactant is not in the above range; or alternatively in the case where the tackiness and/or the microporosity of the granules is to be increased, even when the amount of the inorganic acid preexisting in the liquid acid precursor is in the above range; or the case where the neutralized granules are to be made even smaller.

The mixers usable in this step are not particularly limited. Concrete examples thereof include mixing vessel for liquid components equipped with an agitating device. Also, the mixing may be carried out to an extent such that each of the components is uniformly mixed.

2) Dry-Neutralizing Step

This step comprises adding a mixture of the liquid acid precursor of a non-soap, anionic surfactant and an inorganic acid obtained in the previous step to a water-soluble, solid, alkali inorganic substance, to dry-neutralize of the liquid acid precursor of a non-soap, anionic surfactant. Incidentally, in this step, by adding the liquid acid precursor of a non-soap, anionic surfactant and an inorganic acid, the neutralization reaction and the granulation process concurrently take place, to form the neutralized granules.

Concretely, this dry-neutralizing step includes the following steps:

(a) blending a water-soluble, solid, alkali inorganic substances and/or a known substance generally employed in detergent compositions, wherein the water-soluble, solid, alkali inorganic substance is used in an amount of equal to or greater than that necessary for neutralizing a mixture (amount for neutralization) comprising a liquid acid precursor of a non-soap, anionic surfactant and an inorganic acid in the mixture obtained in the blending step described above; and (b) adding the mixture comprising the liquid acid precursor of a non-soap, anionic surfactant and the inorganic acid obtained in the above blending step to the mixture obtainable in step (a) to neutralize the mixture obtained in step (a) while the mixture remains in a particulate form.

Step (a)

The water-soluble, solid, alkali inorganic substances include any one usually usable as alkalizing agents in detergent compositions. Concrete examples thereof include sodium carbonate, sodium hydrogencarbonate, sodium silicate, potassium carbonate, calcium carbonate, and the like, which may be used alone or in combination. Among the water-soluble, solid, alkali inorganic substances, sodium carbonate can be used as a preferred embodiment because the sodium carbonate can act as a detergent builder and an alkalizing agent in the final detergent composition. Therefore, by adding and blending the water-soluble, solid, alkali inorganic substance components in this step, in amounts sufficient to neutralize a mixture of the liquid acid precursor and the inorganic acid in addition to the amount of sodium carbonate acting as builders and alkalizing agents mentioned above, the neutralization reaction can be favorably carried out.

Specifically, it is preferred that the water-soluble, solid, alkali inorganic substances is added in an amount of equal to or greater than that for neutralization of the liquid acid precursor of a non-soap, anionic surfactant and the inorganic acid (amount for neutralization), for example, preferably 1 to 20 times, more preferably 2 to 10 times, particularly 3 to 8 times, the amount for neutralization.

Also, the average particle size of the water-soluble, solid, alkali inorganic substance is not particularly limited. From the viewpoint of further increase in yield and storage stability, the average particle size is preferably 30 μm or more, more preferably from 40 to 200 μm, particularly from 50 to 100 μm. Here, the average particle size of the water-soluble, solid, alkali inorganic substance is calculated based on volume and measured with a laser diffraction particle size distribution analyzer ("LA-500," manufactured by HORIBA Ltd.).

Further, in the present invention, any of the known substances generally employed in detergent compositions may be also blended. Concrete examples thereof include tripolyphosphates; crystalline or amorphous alkali metal aluminosilicates; crystalline silicates; fluorescers; pigments; anti-redeposition agents, such as polycarboxylate polymers and sodium salt of carboxymethyl cellulose; granular surfactants, such as fatty acids, salts thereof, linear alkylbenzenesulfonates, and alkyl sulfates; spray-dried powders, diatomaceous earth, calcite, kaolin, bentonite, sodium sulfate, sodium sulfite, and the like. The above substances may be optionally used depending upon the application of the granules. When these substances are added, it is desired that they are used as a mixture with the water-soluble, solid, alkali inorganic substance.

In the case where the detergent compositions comprising the tripolyphosphates as main builder components are prepared, the average particle size of the tripolyphosphates is not particularly limited, and the average particle size may be preferably from 1 to 3.0 μm, more preferably from 5 to 20 μm, still more preferably from 6 to 15 μm. From the viewpoint of inhibition of the agglomeration of the detergent granules, smaller the average particle size of the tripolyphosphate, higher the yields. On the other hand, from the viewpoint of productivity for preparing the detergent granules with small particle sizes in an industrial scale, the average particle size of the tripolyphosphates is preferably 1 μm or more. From the viewpoint of inhibiting the agglomeration of the detergent granules, the average particle size is preferably 30 μm or less. Here, in the present specification, the average particle size of the tripolyphosphate is calculated based on volume and measured with a laser diffraction particle size distribution analyzer ("LA-500," manufactured by HORIBA Ltd.).

When the tripolyphosphate is added, the amount of the tripolyphosphate is not particularly limited. When the detergent granules of the present invention per se are used as the detergent composition, or when the detergent granules of the present invention are included as a constituting element of a different detergent composition, the tripolyphosphate is preferably contained in the final granular product in an amount of 2 to 50% by weight, more preferably from 10 to 40% by weight, particularly preferably from 15 to 35% by weight. From the viewpoint of inhibiting the agglomeration of the neutralized granular mixture, the amount of the tripolyphosphate is preferably 2% by weight or more. From the viewpoint of securing the compositional freedom of the resulting detergent composition, the amount is preferably 50% by weight or less.

Further, in cases where detergent compositions having the alkali metal aluminosilicates as main builder components are prepared, an excess agglomeration can be inhibited by the addition of the alkali metal aluminosilicates in this step. Moreover, the alkali metal aluminosilicate also acts as an aid for disintegrating the agglomerated product with the chopper of the agitation granulator. The alkali metal aluminosilicates have an average particle size of from 1 to 30 μm.

Here, the average particle size of the aluminosilicate is calculated based on volume and measured with a laser diffraction particle size distribution analyzer ("LA-500," manufactured by HORIBA Ltd.).

Also, the amounts of fluorescers, pigments, anti-redeposition agents, granular surfactants, spray-dried powders, diatomaceous earth, calcite, kaolin, bentonite, sodium sulfate, sodium sulfite, and the like are not particularly limited.

The mixers usable in step (a) for blending each of the above components are not particularly limited, and an agitation granulator may be suitably used. The agitation granulators are not particularly limited, and it is preferred that the agitation granulators are equipped with agitation blades and a chopper for disintegration and dispersion (or with a functionally equivalent means).

Concrete examples of the agitation granulators usable in the present invention for a batch process include Vertical Granulator (manufactured by Powrex Corp.); High-Speed Mixer (manufactured by Fukae Powtec Kogyo Corp.); Lödige Mixer (manufactured by Matsubo Co., Ltd.); PLOUGH SHARE Mixer (manufactured by PACIFIC MACHINERY & ENGINEERING Co., LTD.); Gericke Mixer (manufactured by Meiji Machine Co., Ltd.), and the like. Here, particular preference is given to the Lödige Mixer and the PLOUGH SHARE Mixer. Concrete examples of the agitation granulators usable for a continuous process include continuous Lödige Mixer (moderate speed mixer: those having relatively long residence time); CB recycler (manufactured by Lödige) as a high-speed mixer (having relatively short residence time); Turbilizer (manufactured by Hosokawa Micron Corporation); Shugi Mixer (manufactured by Powrex Corp.); Flow Jet Mixer (manufactured by Funken Powtechs, Inc.), and the like. Incidentally, in the present invention, the above mixers may be suitably used in combination.

Also, it is more preferred that the agitation granulators are equipped with a jacket for adjusting the internal temperature of the granulator and a nozzle for blowing a gas into the agitation granulator.

The extent of mixing in step (a) is not particularly limited, and mixing may be preferably carried out to an extent such that each of the components is uniformly mixed. For instance, in the case where the agitation granulators are used in this step, the operating conditions of the agitation granulators may be, for example, preferably a blending time of within five minutes. The agitating speed of the main shaft and the chopper speed for disintegration and dispersion may be suitably set depending on the kinds of the mixers used. For instance, in the case of mixers for a batch process, the peripheral agitating speed of the main shaft is preferably from 2 to 15 m/s, and the peripheral chopper speed for disintegration and dispersion is preferably from 20 to 60 m/s.

Incidentally, during blending, or at the completion of blending in step (a), water may be added as a reaction initiating agent. By adding the reaction initiating agent, the neutralization reaction can be favorably accelerated. The amount of water added is not particularly limited, and the amount of water is preferably from 0.2 to 3 parts by weight, more preferably from 0.5 to 1.5 parts by weight, based on 100 parts by weight of the powdery mixture in step (a). From the viewpoint of initiating the neutralization reaction, the amount of water is preferably 0.2 parts by weight or more, and from the viewpoint of inhibiting the agglomeration of the detergent granules, the amount is preferably 3 parts by weight or less. Incidentally, in cases where the above components, such as the liquid acid precursor of a non-soap, anionic surfactant, contain water, or in cases where other aqueous starting material solutions are used, or in cases where water-containing powdery starting materials are used, the amount of water to be added may be determined by considering the water contents of these components.

In addition, as still more preferred reaction initiating agents, an aqueous solution of alkalis may be added. By using an aqueous solution of alkalis as a reaction initiating agent, when compared with water, not only the neutralization reaction can be further accelerated, but also the particle size of the resulting detergent granules can be made small and thus the bulk density can be made large.

The amount of the aqueous solution of alkalis is preferably from 0.05 to 0.5 times the amount, more preferably from 0.10 to 0.45 times the amount, particularly preferably from 0.15 to 0.40 times the amount, for neutralizing the liquid acid precursor of a non-soap, anionic surfactant. From the viewpoint of initiating the neutralization reaction to obtain desired effects, the amount of the aqueous solution of alkalis is preferably equal to or greater than 0.05 times the amount for neutralization, and from the viewpoint of inhibiting the agglomeration of the detergent granules, the amount is preferably equal to or less than 0.5 times the amount for neutralization. Incidentally, although the concentration of the aqueous solution of alkalis is not particularly limited, in cases of low concentrations, excess amount of water is supplied to the mixture along with the given amount of the aqueous solution of alkalis, so that the agglomeration of the detergent granules is liable to take place. Therefore, the concentration of the aqueous solution of alkalis is preferably from 20 to 50% by weight, more preferably 30 to 50% by weight, particularly preferably from 40 to 50% by weight.

Also, the kinds of the aqueous solutions of alkalis usable in the present invention are not particularly limited. Examples thereof include aqueous sodium hydroxide, aqueous potassium hydroxide, and the like, which are aqueous solutions of strong-alkalis which easily cause neutralization reaction with the liquid acid precursors of the non-soap, anionic surfactants. Among them, the aqueous sodium hydroxide is suitably used from the viewpoint of costs. Also, it is more preferred that the aqueous solutions of alkalis mentioned above have a pH of 12 or more.

In addition, mixing in this step may be preferably carried out to an extent such that the added aqueous solution of alkalis is uniformly dispersed.

Step (b)

In step (b), in order to carry out the dry-neutralization process of the liquid acid precursor of a non-soap, anionic surfactant, the liquid acid precursor or a mixture of the liquid acid precursor and the inorganic acid may be gradually added to the water-soluble, solid alkali inorganic substance. The time required for the addition of the liquid acid precursor or the above mixture depends upon the amount of the liquid acid precursor or the above mixture added and thus cannot be generalized. In the case of employing mixing in a batch process, the time required is generally one minute or more, more preferably from 1 to 10 minutes, still more preferably 2 to 7 minutes. Here, when the liquid acid precursor or the above mixture is added in an extremely short time, the liquid acids remaining unreacted accumulate, thereby making it likely to cause excess agglomeration. Therefore, it is preferred that the liquid acid precursor or the above mixture is added in one minute or longer.

Also, the liquid acid precursor or the above mixture may be added continuously or added separately in plural portions. Also, a plurality of addition means may be provided.

Incidentally, the mixers usable in step (b) are not particularly limited, with a preference given to the agitation granulators exemplified in step (a).

After the addition of the liquid acid precursor or the above mixture, it is desired that the agitation granulator is operated for additional 30 seconds or more, more preferably one minute or more. By having this step, the neutralization reaction and the granulation process can be favorably completed.

In step (b), it is preferred that the neutralization is carried out while blowing a gas into an agitation granulator. This is because the excess water produced in the neutralization reaction can be evaporated and the granular product can be cooled with the gas, to thereby inhibit the granular product from forming into a doughy mass. The gas includes an $N_2$ gas, air, and the like. The amount of gas blown (amount of gas flow) is not particularly limited. The gas is blown at a rate of preferably equal to or greater than 0.002 parts by weight per minute, more preferably equal to or greater than 0.02 parts by weight per minute, based on 100 parts by weight of the granular product.

By carrying out the above processes, the dry-neutralization process is completed.

The detergent granules obtainable by the method of the present invention described above may be further subjected to surface modification. In other words, the method for producing the detergent granules of the present invention may further comprise the step of adding a free-flowing aid to the detergent granules obtained after the dry-neutralizing step, to surface-modify the detergent granules. By surface-modifying the detergent granules, since further improvements in the free-flowability and the storage stability of the resulting detergent granules can be attained, the surface-modifying step is suitably provided, for instance, in a case where the detergent granules of the present invention are included as one constituting element of the detergent composition. The surface modification can be carried out by adding a surface modifier as a free-flowing aid while blending the detergent granules in an agitation granulator (surface-modifying step).

The surface modifiers may be any of conventionally known ones, and crystalline or amorphous alkali metal aluminosilicates (zeolite), calcite, diatomaceous earth, silica, and the like may be suitably used. The above aluminosilicates more preferably have an average particle size of 10 $\mu$m or less. Also, the amount of the surface modifiers in the detergent composition, which is the final product, is preferably from 2 to 15% by weight, more preferably from 4 to 12% by weight. Incidentally, the average particle size of the surface modifier is calculated based on volume and measured with a laser diffraction particle size distribution analyzer ("LA-500," manufactured by HORIBA Ltd.).

Also, the operating time of the agitation granulator in cases where the surface modifiers are added is not particularly limited, and the operating time may be preferably from 1 to 5 minutes.

Incidentally, in the method of the present invention, the optional liquid components may be added depending upon the composition of the detergent compositions to be obtained (step of adding liquid components). The addition of the liquid components may be carried out at any stage without particular limitation. For instance, the addition of the liquid components may be carried out prior to or during the process of the dry-neutralization, or the addition may be alternatively carried out after the dry-neutralization. It is preferred that the addition is carried out prior to the addition of the surface modifiers. However, in certain cases where the detergent granules obtained after the step of adding the liquid components have excellent free-flowability and/or excellent storage stability, it is unnecessary to add the surface modifier as a free-flowing aid.

Examples of the liquid components include any optional liquid components in detergent compositions, including nonionic surfactants; water-soluble polymers, such as polyethylene glycol, acrylic acid-maleic acid copolymers, and the like; fatty acids, and the like. The liquid components may be used singly or a combination of two or more kinds. From the viewpoint of inhibiting the agglomeration of the detergent composition, the amount of the liquid components may be preferably 15% by weight or less, more preferably 10% by weight or less, of the detergent composition, which is the final product.

Further, in the present invention, any of the following known substances generally employed in detergent compositions may be also blended to the detergent granules obtained after the dry-neutralizing step. For instance, these substances may be added prior to the step of adding liquid components and/or prior to the surface-modifying step. Examples of these substances include tripolyphosphates, crystalline or amorphous alkali metal aluminosilicates, crystalline silicates, fluorescers, pigments, anti-redeposition agents such as polycarboxylate polymers and sodium salt of carboxymethyl cellulose, granular surfactants such as fatty acids, salts thereof, linear alkylbenzenesulfonates and alkyl sulfates, spray-dried powders, diatomaceous earth, calcite, kaolin, bentonite, sodium sulfate, sodium sulfite, and the like. The above substances can be optionally used depending upon the applications thereof.

Also, the operating time of the agitation granulator in cases where the addition of the liquid components is carried out prior to the addition of the surface modifiers is not particularly limited, and the operating time may be preferably from 0.5 to 8 minutes.

Specifically, there are the following embodiments as preferred embodiments for the methods for producing the detergent granules of the present invention:

[1] an embodiment further comprising the step of adding a liquid component after the dry-neutralizing step; and

[2] an embodiment further comprising the step of adding a free-flowing aid after the step of adding a liquid component in embodiment [1], to surface-modify the detergent granules.

The hue of the surface-modified, detergent granules obtained by the method described above is not particularly limited. For instance, in the case where the particle size of the surface-modified, detergent granules is evenly sized at 350 to 500 $\mu$m and the above detergent granules is analyzed by photoelectric calorimeter, the Hunter Lab coloration is desirably 90 or more in its L value.

In the present invention, the following optional components may be further added to the detergent composition. The optional components include, for instance, enzymes, perfumes, bleaching agents, pigments, and the like. Such optional components may be formulated by blending the detergent granules obtainable by the method of the present invention with the above components using mixers, such as a rotary mixer.

Modes for carrying out the present invention are not limited to the above methods. In other words, the present invention is applicable for the methods for producing known powdery detergent compositions having high bulk density and for methods for producing the commercial products thereof, the high-bulk density detergent compositions being obtained by the dry-neutralization process of the liquid acid precursor of an anionic surfactant.

In general, the particle size of the detergent granules obtained by the dry-neutralization process increases as the proportion of the non-soap, anionic surfactant increases. Also, similarly, the particle size tends to increase as the proportions of the other liquid starting materials, such as nonionic surfactants and polymer solutions, increase. For instance, among the granules obtainable by the dry-neutralization process having extremely high proportion of the anionic surfactant, in the case where the proportion of the granules having suitably small particle size is low, the granules of the desired particle size range can be obtained at high yields by pulverizing an entire amount of the obtained neutralized granules in the presence of a pulverizing aid, and then classifying the granules. Also, when the proportions of the other liquid starting materials, such as nonionic surfactants and polymer solutions, are increased, the granules having suitably small particle size can be obtained at high yields.

Also, the detergent granules obtainable by the method of the present invention may be used as a constituting element of a different detergent composition.

In addition, in the present invention, blending may be carried out by supplying each of the liquid acid precursor of a non-soap, anionic surfactant, the water-soluble, solid alkali inorganic substance, and the inorganic acid at once. In this case, the blending process and the neutralization and granulation process are concurrently carried out. This embodiment is highly preferable for the method in a continuous process.

The detergent granules of the present invention thus obtained comprise a non-soap, anionic surfactant and an inorganic salt undetectable by X-ray diffraction method, wherein the molar ratio of [inorganic salt undetectable by X-ray diffraction method]/[non-soap, anionic surfactant] is from 0.1 to 1.0.

The biggest feature of the detergent granules of the present invention is in that the above inorganic salt is undetectable by X-ray diffraction method. Here, the phrase "undetectable by X-ray diffraction method" means that the material does not have a definite diffraction peak in the analysis of the sample by X-ray diffraction method, and that the identification of peaks cannot be made even when using any of diffraction patterns reported, for instance, in JCPDS (Joint Committee on Powder Diffraction Standards). Incidentally, in X-ray diffraction patterns, in certain cases, no definite diffraction peaks but indefinite diffraction halo patterns May be observed. However, even in such cases it cannot be said to be detectable by X-ray diffraction method. Typical examples of the inorganic salts include sodium sulfate (Glauber's salt).

Figure 2:
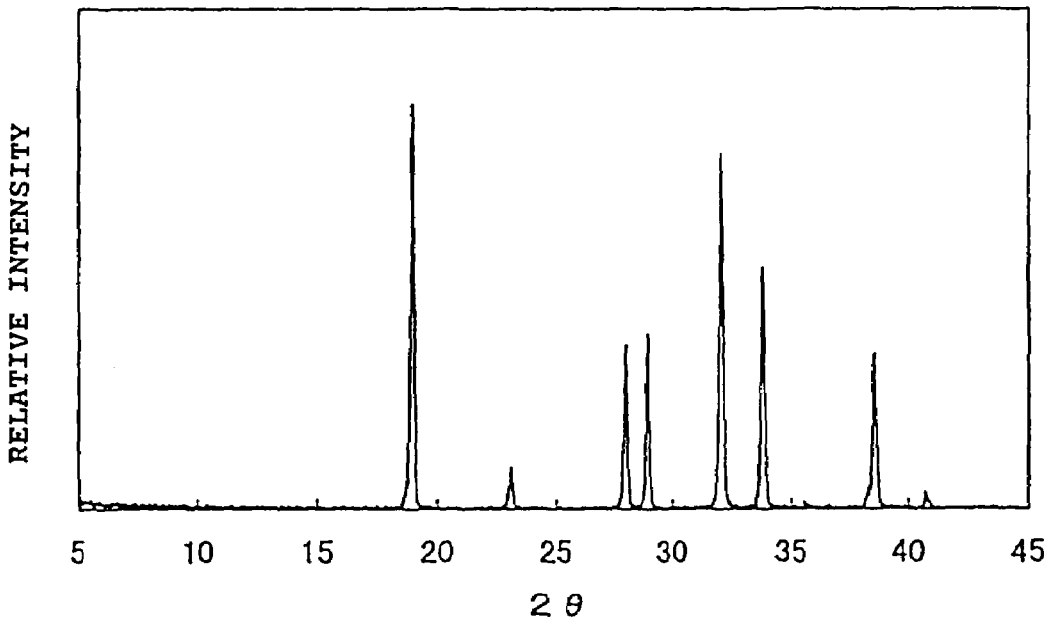
FIG. 2 is a graph showing X-ray diffraction patterns of the powdery sodium sulfate.
Figure 3:
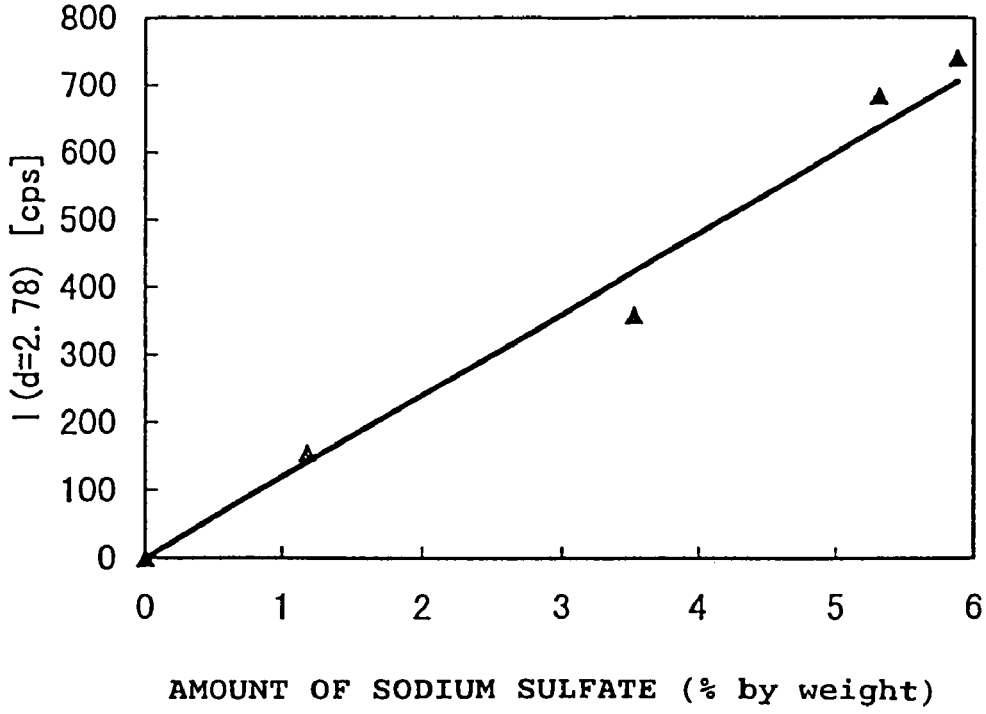
FIG. 3 is a graph showing the relationship between the amount of the sodium sulfate added as the starting material in the preparation of the detergent compositions and the peak intensity at d=2.78 in the X-ray diffraction analysis. This graph can be used as a calibration curve for determining the "powdery sodium sulfate" added as the starting material contained, in the detergent composition from the peak intensity obtained by X-ray diffraction analysis of the detergent composition.
Figure 4:
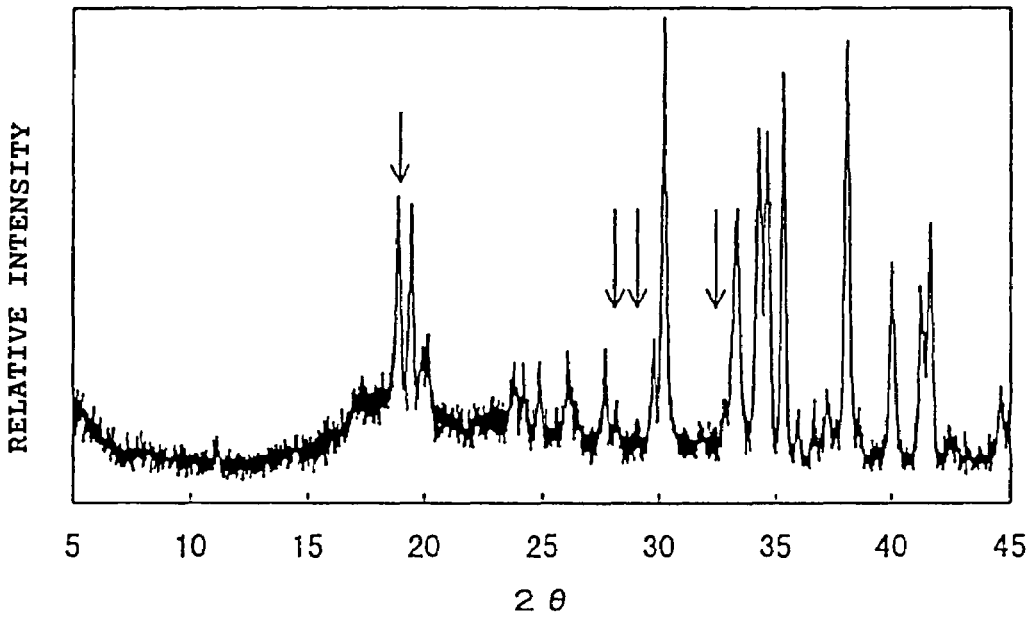
FIG. 4 is a graph showing X-ray diffraction patterns of the detergent composition obtained in Example 12. In the figure, the arrows indicate the diffraction peaks of the powdery sodium sulfate.

For instance, since the detergent granules of Comparative Example 13, which is produced without using the method of the present invention, contain powdery sodium sulfate ($Na_2SO_4$), diffraction peaks shown in FIG. 1 are detectable in X-ray diffraction patterns of the granules. These peaks are identified as sodium sulfate, for instance, by No. 37-1465 of JCPDS (FIG. 2). Also, as shown in FIG. 3, the amount of the powdery sodium sulfate can be quantified by preparing a calibration curve of the powdery sodium sulfate and the X-ray peak intensities using the X-ray diffraction peaks. By contrast, as typically exemplified by Example 12, in the granules of the present invention, diffraction peaks ascribed to any of the diffraction patterns of sodium sulfate are undetectable by X-ray diffraction method (FIG. 4), even though sodium sulfate can be chemically quantified by the method described below, thereby making it impossible to identify the sodium sulfate by X-ray diffraction method.

Figure 5:
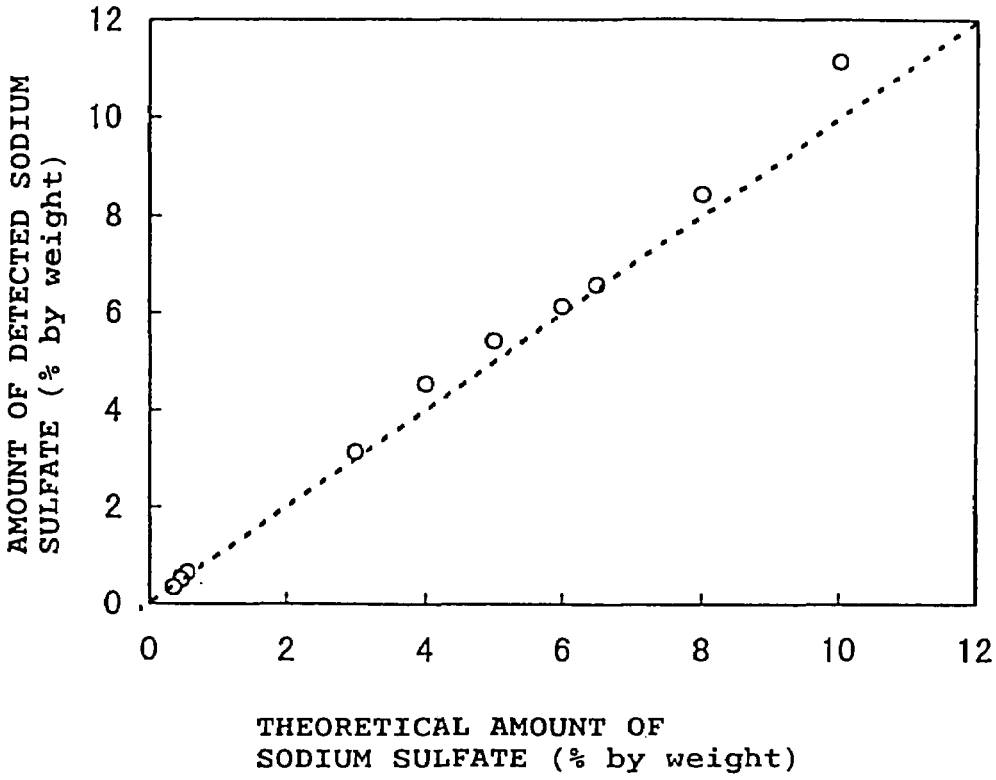
FIG. 5 is a graph showing the relationship between the entire amount of the sodium sulfate in the detergent composition theoretically calculated from the starting material composition and the amount of sodium sulfate in the detergent composition quantified by ion chromatography. The graph is prepared by the chemically determined amounts of sodium sulfate in the detergent compositions of Examples 11, 12, 13, 16, 17, 18, and 21 and Comparative Examples 11, 16, and 19. This graph can be used as a calibration curve for obtaining the "entire amount of sodium sulfate" contained in the detergent composition.

On the other hand, the content of the inorganic salt in the detergent granules can be chemically quantified, for instance, by analyzing means, such as ion chromatography. For example, in a case where the inorganic salt is a sulfate, it is possible to quantify the sulfate contained in the detergent granules by using a calibration curve of sulfate ions prepared in advance. Similarly in the detergent granules of the present invention, the sulfate contained in the granules can be quantified as shown in FIG. 5. Also, the non-soap, anionic surfactant can be quantified, for instance, by carrying out qualitative and quantitative methods in a synthetic detergent testing method (according to JIS K3362) for the anionic surfactants.

In the case where inorganic salts, such as powdery sodium sulfate and powdery sodium phosphate, obtained by the process other than the dry-neutralization process in the method of the present invention, are not used at all as the starting materials, since the inorganic salts, such as sodium sulfate and sodium phosphate, contained in the detergent granules and formed by the method of the present invention are undetectable by X-ray diffraction method, the amount of the inorganic salts chemically quantified would be considered to be the same as "the amount of the inorganic salt undetectable by X-ray diffraction method." Therefore, the molar ratio of [inorganic salt undetectable by X-ray diffraction method]/[non-soap, anionic surfactant] can be calculated from the amount of the inorganic salts and the amount of the non-soap, anionic surfactant quantified by the methods described above. Incidentally, even in cases where, for instance, the powdery sodium sulfate mentioned above and the detergent granules of the present invention are mixed to give a desired detergent composition, the amount of the inorganic salt undetectable by X-ray diffraction method can be calculated by the difference in the amounts of sodium sulfate as shown in FIG. 5 and FIG. 3, and the above molar ratio can be calculated from this value.

The detergent granules of the present invention comprise a non-soap, anionic surfactant and an inorganic salt undetectable by X-ray diffraction method, wherein the molar ratio of [inorganic salt undetectable by X-ray diffraction method]/[non-soap, anionic surfactant] is from 0.1 to 1.0. From the viewpoint of suppressing the tackiness of the granules, the molar ratio is preferably 0.1 or more, and from the viewpoint of securing the compositional freedom of the detergent composition, the molar ratio is preferably 1.0 or less.

The detergent granules of the present invention mentioned above have the properties of (1) having extremely low tackiness of the granules, and (2) having a large number of micropores. The detailed properties of the granules of the present invention will be described hereinbelow.

(1) Low Tackiness

The present inventors have found that the detergent granules of the present invention show extremely low tackiness of the granules, and that this tackiness is dependent upon the molar ratio of the inorganic salt to the non-soap, anionic surfactant, wherein larger the molar ratio of the inorganic salt, lower the tackiness of the granules.

Here, the tackiness of the granules can be evaluated by a fracture load of the compression molding product of the granules as detailed below. A cylinder having 40 mm in diameter is uniformly charged with a 40 g sample, and a 1 kg load is applied with a piston, and the piston-charged cylinder is allowed to stand for three minutes, to thereby mold the granules into cylindrical shapes. The molded samples are taken out of the cylinder. Thereafter, a force required for breaking the molded sample is measured by using a rheometer (manufactured by Fudohkogyo K.K.), and this force is defined as the fracture load. In general, smaller the value of the fracture load, smaller the tackiness of the granules and less the agglomeration being caused thereby. The fracture load varies depending upon the amounts formulated, and the values of the fracture load of the detergent granules of the present invention are lower than those of the granules with the same compositions to the present invention except for the amount of the inorganic salt used in the method of the present invention, so that improvements in the tackiness of the granules in the detergent granules of the present invention can be confirmed.

The present inventors have found that the detergent granules obtained by the method of the present invention comprise a composite layer containing the inorganic salt and the non-soap, anionic surfactant in the surface layer of the granules. Also, they have found that since the inorganic salts are present in relatively larger amounts at near the surface of the detergent granules than in the inner portion of the granules, the tackiness of the granules can be suppressed.

As an example of methods of confirming the states of the above detergent granules, there can be employed a method of utilizing both Fourier transform infrared spectroscopy (FT-IR) and photoacoustic spectroscopy (PAS) in combination (simply abbreviated as "FT-IR/PAS"). As described in "*APPLIED SPECTROSCOPY*," Vol. 47, p. 1311–1316 (1993), in the FT-IR/PAS, spectra taken in the direction of from the surface to the depths of the samples can be measured without changing the shapes of the samples, so that it is possible to identify the distribution states of the substances in the direction of depth from the surface of the detergent granules.

The concrete measurement method is as follows.

A cell is charged with samples to conduct FT-IR/PAS measurement, and the measurement points taken at any depths up to about 20 $\mu$m from the surface are analyzed. Concretely, in the phase modulation FT-IR/PAS spectra at a constant phase modulation frequency, a magnitude spectrum at given phase angle is obtained by synchronously analyzing PAS spectral components at a given phase angle and at an angle with a 90° phase shift from the given phase angle. The FT-IR spectrum is measured, for instance, by using an infrared spectrometer "FTS-60A/896" (manufactured by Bio-Rad Laboratories), and the PAS cell includes an acoustic detector "Model 300" manufactured by MTEC Corporation. Scanning with an interferometer is conducted by a step-scan method, and the modulation frequency is set at 2.5 kHz. Peak intensities are detected from the obtained spectra for the sodium linear alkylbenzenesulfonate (LAS-Na) and sodium sulfate respectively at 1222 $cm^{-1}$ ($SO_3$ anti-symmetric stretching vibration) and 1149 $cm^{-1}$ ($SO_4$ stretching vibration).

Figure 6:
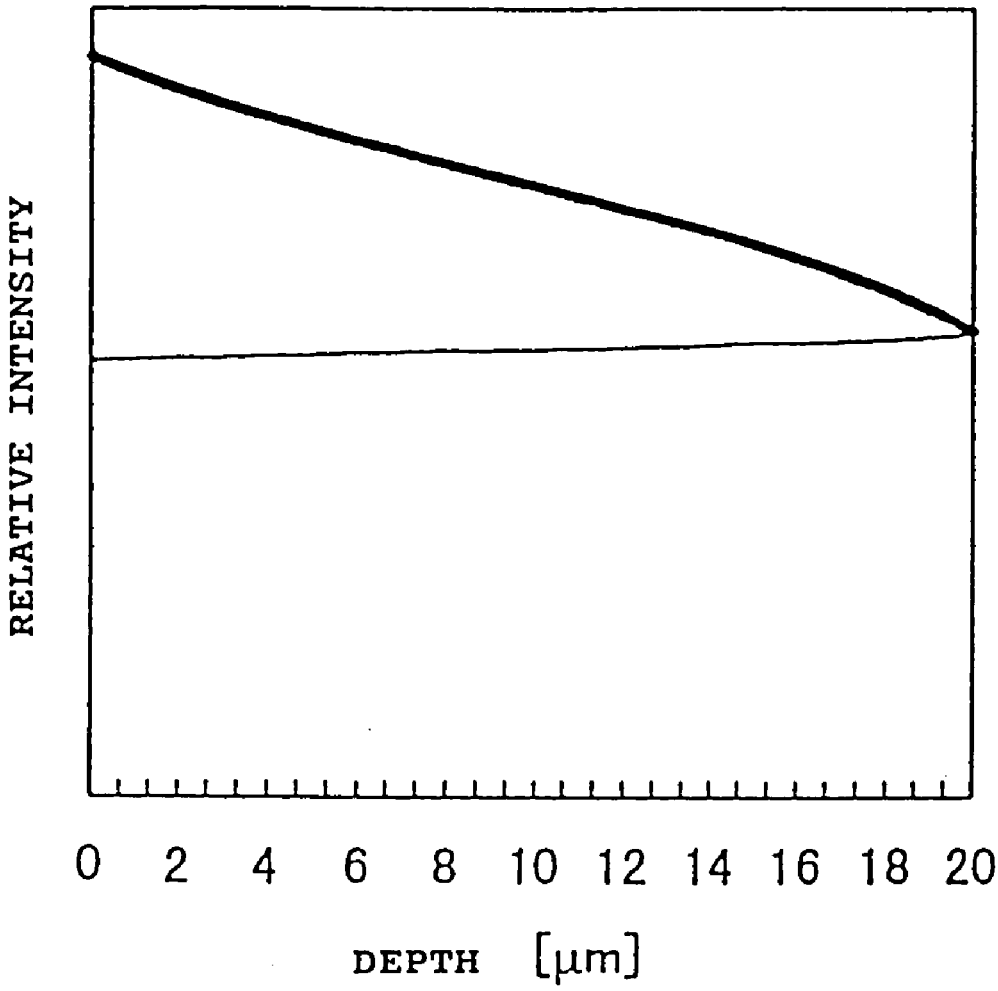
FIG. 6 is a graph showing the relationship between the depths from the surface of the granules of the detergent compositions and the relative intensity of the peaks ascribed to sodium sulfate, an inorganic salt (namely, the ratio between the peak intensity of sodium sulfate and the peak intensity of the LAS-Na), as determined by FT-IR/PAS analysis of the detergent compositions obtained in Example 11 and in Comparative Example 11. Here, bold line represents data of Example 11, and solid line represents data of Comparative Example 11.

A typical example of the above measurement is shown in FIG. 6. As is clear from in FIG. 6, in the case of the detergent granules obtainable in Example 11, it is found that the relative intensity of the peaks ascribed to sodium sulfate, an inorganic salt (namely, the ratio between the diffraction peak intensity of sodium sulfate and the diffraction peak intensity of the LAS-Na) is high in the surface layer of the granules when compared to the sodium sulfate which is present in the inner portion of the granules, i.e. the detergent granules have relatively large contents of the inorganic salt present in the surface layer. By contrast, in the case of the detergent granules obtainable in Comparative Example 11, the diffraction peak intensity ascribed to the inorganic salt shows substantially no changes from the inner portion of the granules to the surface layer of the granules, and when compared with Example 11, the diffraction peak intensity value is low and constant. In addition, the tackiness of the granules (evaluated by the values of the fracture load) of each of the granules is 673 gf for the granules of Example 11 in contrast to 1124 gf for the granules of Comparative Example 11, thereby showing that the detergent granules of the present invention are low-tackiness granules by forming an inorganic salt on the surfaces of the granules by dry neutralization.

(2) Microporosity

The feature of the detergent granules of the present invention resides in having a large number of micropores in the granules in addition to having the low tackiness mentioned above. By having a larger number of micropores in the granules, it is considered that the liquid content which can be retained in the micropores of the granules increases, so that excess agglomeration of the granules owing to the bleeding out of the liquid starting materials during the production of granules can be suppressed. The microporous capacity in the granules can be measured, for instance, by known mercury pressure method (for example, a mercury porosimeter "PORESIZER 9320," manufactured by Shimadzu Corporation). The detergent granules of the present invention have a microporous capacity larger than that of the detergent granules obtainable by conventional method of dry neutralization.

Figure 7:
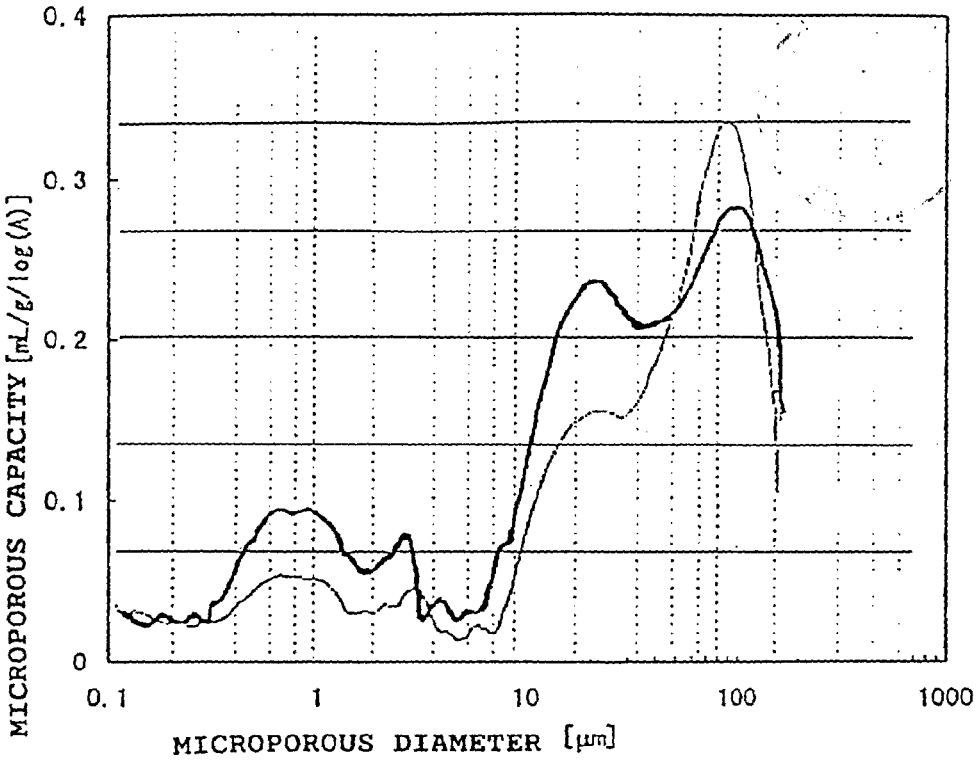
FIG. 7 is a graph showing the relationship of the microporous diameter and the microporous capacity of the detergent compositions obtained in Example 18 and in Comparative Example 16. Here, bold line represents data of Example 18, and solid line represents data of Comparative Example 16.

In order to illustrate the effects of the size of the microporous capacity, Example 18 and Comparative Example 16 may be compared as shown in FIG. 7.

FIG. 7 is a graph showing the relationship of the microporous diameter and the microporous capacity of the detergent compositions obtained in Example 18 and in Comparative Example 16. The microporous diameter is measured by a mercury porosimeter "PORESIZER 9320," manufactured by Shimadzu Corporation, and the microporous capacity is measured by mercury pressure method. The entire microporous capacity of the detergent composition obtained in Example 18 is 0.402 mL/g, and the entire microporous surface areas of the detergent composition are 0.711 $m^2$/g. Also, the entire microporous capacity of the detergent composition obtained in Comparative Example 16 is 0.327 mL/g, and the entire microporous surface areas of the detergent composition are 0.547 $m^2$/g.

In Comparative Example 16, the molar ratio of the inorganic acid to the liquid acid precursor of a non-soap, anionic surfactant is 0.04, smaller than the lower limit in the present invention. On the other hand, in Example 18, the detergent granules are produced by dry neutralization under the conditions that the molar ratio of the inorganic acid to the liquid acid precursor of a non-soap, anionic surfactant is 0.44. When the entire microporous capacity and the microporous surface areas of both of the detergent granules are compared, all of the values are larger in the detergent granules of Example 18 than those in the detergent granules of Comparative Example 16. Also, the average particle size of the detergent granules is 493 $\mu$m for Example 18 whereas the average particle size is 1313 $\mu$m for Comparative Example 16. From these results, it is considered that since the detergent granules of Example 18 have larger entire microporous capacity and entire microporous surface area than those of Comparative Example 16, the liquid content which can be retained in the micropores in the granules increases, so that excess agglomeration of the granules owing to the bleeding out of the liquid starting materials during the production of granules can be suppressed.

In the case where the detergent granules are designed or produced utilizing the above features of the detergent granules of the present invention, the following can be exemplified as preferred embodiments according to its utility. Specifically, (1) the detergent granules comprising a non-soap, anionic surfactant and an inorganic salt undetectable by X-ray diffraction method, wherein the amount of the non-soap, anionic surfactant is in an amount of 28% by weight or more and less than 50% by weight, and a molar ratio of [inorganic salt undetectable by X-ray diffraction method]/[non-soap, anionic surfactant] is from 0.1 to 1.0; and (2) the detergent granules comprising a non-soap, anionic surfactant and an inorganic salt undetectable by X-ray diffraction method, wherein the amount of the non-soap, anionic surfactant in an amount of 10% by weight or more and less than 28% by weight in the detergent granules, and a molar ratio of [inorganic salt undetectable by X-ray diffraction method]/[non-soap, anionic surfactant] is from 0.3 to 1.0.

Detergent Granules of Embodiment (1)

In general, in the detergent granules containing large amounts of the non-soap, anionic surfactant, it is difficult to produce the granules having excellent free-flowability with small particle sizes. This is because the agglomeration of the granules is likely to take place owing to the tackiness inherently owned by the non-soap, anionic surfactant. Therefore, in the case, for instance, where the detergent granules are produced by conventional method, the tackiness of the granules is likely to give mal-effects during the production of the granules when the content of the non-soap, anionic surfactant is relatively large, for example, when the content is 20% by weight or more in the granules, more remarkably 28% by weight or more and less than 50% by weight, particularly remarkably 30% by weight or more and less than 50% by weight.

Therefore, it is preferred from the aspect of strongly exhibiting the effects of suppressing their tackiness that the detergent granules of the present invention comprise a non-soap, anionic surfactant and an inorganic salt undetectable by X-ray diffraction method, wherein the amount of the non-soap, anionic surfactant is in an amount of 28% by weight or more and less than 50% by weight, and a molar ratio of [inorganic salt undetectable by X-ray diffraction method]/[non-soap, anionic surfactant] is from 0.1 to 1.0. Also, in the detergent granules, the molar ratio of [inorganic salt undetectable by X-ray diffraction method]/[non-soap, anionic surfactant] is more preferably from 0.1 to 0.8, still more preferably from 0.15 to 0.65, particularly preferably from 0.2 to 0.6, most preferably from 0.25 to 0.55.

Detergent Granules of Embodiment (2)

Also, when the microporous capacity of the granules is remarked, since the detergent granules of the present invention have a large microporous capacity, the liquid components, such as nonionic surfactants, can be included in larger amounts in the micropores. From the above viewpoint, in a case where larger amounts of the liquid components, such as nonionic surfactants, are contained, there can be used as a preferred embodiment the detergent granules comprising a non-soap, anionic surfactant and an inorganic salt undetectable by X-ray diffraction method, wherein the amount of the non-soap, anionic surfactant in an amount of 10% by weight or more and less than 28% by weight in the detergent granules, and a molar ratio of [inorganic salt undetectable by X-ray diffraction method]/[non-soap, anionic surfactant] is from 0.3 to 1.0. In the above detergent granules, it is more preferred that the non-soap, anionic surfactant is contained in the detergent granules in an amount of 15% by weight or more and less than 28% by weight, particularly preferably from 15 to 26% by weight. From the viewpoint of giving high washing power, the amount of the non-soap, anionic surfactant in the detergent granules is preferably 10% by weight or more. From the viewpoint of suppressing the foaming of the detergent composition upon use, the amount is preferably less than 28% by weight. Also, the detergent granules in this embodiment have a molar ratio [inorganic salt undetectable by X-ray diffraction method]/[non-soap, anionic surfactant] of more preferably from 0.3 to 0.8, particularly preferably 0.35 to 0.7.

The detergent granules of the present invention having the properties mentioned above may be used as such as a high-bulk density detergent composition, or the detergent granules may be used as one of components constituting a detergent composition.

The amount of the liquid acid precursors of a non-soap, anionic surfactants can be appropriately set depending upon the composition of the desired detergent composition. The amount of the liquid acid precursors may be so added to include the anionic surfactants produced by the neutralization reaction in the final detergent composition product in an amount of preferably from 5 to 50% by weight, more preferably from 5 to 45% by weight, still more preferably from 10 to 40% by weight, particularly preferably from 20 to 40% by weight, within which range the effects of the present invention can be remarkably exhibited, which become particularly remarkable in the range where the amount of the anionic surfactant is large.

Also, it is more desired that the detergent granules of the present invention or the high-bulk density detergent composition comprising the detergent granules obtainable by the method of the present invention have a bulk density of 500 g/L or more and that those detergent granules have the following properties.

Bulk density: Those having 650 to 950 g/L are preferred, those having from 700 to 900 g/L are more preferred. In the present specification, the bulk density is a value evaluated by the method defined in JIS K 3362;

Average particle size: As to the average particle size, from the viewpoint of solubility rate of the detergent granules, those having 850 μm or less are preferred, those having from 300 to 800 μm are more preferred. The proportion of the particles of 1400 μm or less, namely the percentage of 1400 μm-pass particles, may vary in their suitable ranges depending upon the concentration of the non-soap, anionic surfactant in the resulting high-bulk density detergent composition. For instance, when the concentration of the non-soap, anionic surfactant is from 35 to 40% by weight, the percentage of 1400 μm-pass particles is preferably 60% or more, more preferably 70% or more. When the concentration of the non-soap, anionic surfactant is less than 35% by weight, the percentage of 1400 μm-pass particles is preferably 75% or more, more preferably 80% or more. In the present specification, the average particle size of the detergent composition is obtained from the weight percentages depending on the sizes of the sieves after vibrating a standard sieve according to JIS K 8801 for five minutes, and the percentage of 1400 μm-pass particles means the weight percentage of the proportion occupied by the particles of 1400 μm or less; and Free-flowability: Evaluated in terms of flow time of preferably 8 seconds or less, more preferably 7 seconds or less. In the present specification, the free-flowability of the detergent composition is defined as a time period required for discharging 100 ml of powder from a hopper used in a measurement of bulk density according to JIS K 3362.

The present invention will be explained in further detail by means of the following working examples and comparative examples, without intending to limit the scope of the present invention to these examples.

EXAMPLE 1

The detergent composition having the composition shown in Table 1 was prepared in an amount of 35 kg for each unit using a high speed mixer "Lödige Mixer FKM-130D" (manufactured by Matsubo Co., Ltd.). This mixer was equipped with agitator blades and a shearing device, the shearing device corresponding to a chopper for disintegration and dispersion.

Here, the following procedures were carried out.

Powder Blending

The solid ingredients consisting of 7.0 parts by weight of sodium tripolyphosphate (STPP; average particle size: 11.2 μm), 12.61 parts by weight of sodium carbonate ("LIGHT ASH," manufactured by Central Glass Co., Ltd.; average particle size: 56.1 μm), and 0.11 parts by weight of a fluorescer were blended for one minute under the conditions of a rotational speed of agitator blades of 130 rpm (peripheral speed: 3.4 m/s) and a rotational speed of shearing device of 2850 rpm (peripheral speed: 27 m/s) by the Lödige Mixer.

Addition of Reaction Initiating Agent

Water was added to the contents in the mixer in an amount of 0.20 parts by weight as a reaction initiating agent, and the blending was carried out for one minute and thirty seconds under the same blending conditions as above.

Neutralization

While the mixer was operated under the same conditions as above, 10.92 parts by weight of a linear alkylbenzenesulfonic acid (LAS; molecular weight: 322) and 0.23 parts by weight of 98% sulfuric acid, which were mixed in advance, were added to the contents in the mixer in four minutes. During the addition, the ingredients were cooled by allowing water to flow through the mixer jacket at 25° C. At this stage, the temperature rose to 75° C. at the highest. Incidentally, throughout this stage, the reaction mixture remained in a granular form. Incidentally, the LAS mentioned above was obtained by $SO_3$ gas sulfonation method and contained 0.16 parts by weight of sulfuric acid. In other words, the resulting mixture contained 0.05 mol of sulfuric acid per mol of the LAS. Also, the proportion of sulfuric acid to the LAS during neutralization reaction was such that the reaction mixture contained 0.12 mol of sulfuric acid per mol of the LAS. The amount of sodium carbonate was about six times the amount required for neutralizing the LAS and sulfuric acid.

After the addition of the LAS, the mixer was continuously operated under the same conditions for one minute to complete the neutralization reaction and the granulation process.

Addition of Liquid Ingredients and Surface Modification

At a point where the neutralization reaction and the granulation process were completed, an aqueous solution of a 40% by weight acrylic acid-maleic acid copolymer was added to the mixer with an effective amount of the copolymer being 0.18 parts by weight, while the mixer was operated under the same conditions as above, and the ingredients were mixed for one minute and thirty seconds. Thereafter, the resulting mixture was subjected to a surface modification treatment by adding 4.20 parts by weight of zeolite having an average particle size of 4 μm to the mixer as a surface modifier, and operating the mixer for additional two minutes. Incidentally, the zeolite contained 0.84 parts by weight of a crystal water.

The resulting granules of the detergent composition had percentage of particles with 1400 μm-pass: 75.3%; average particle size: 633 μm; bulk density: 760 g/L; free-flowability: 6.2 seconds; and hue: 92.4. Accordingly, the granules showed excellent properties.

After-Blending

Using a rotary mixer, 0.18 parts by weight of enzyme granules and the detergent composition obtained above were blended, and thereafter 0.07 parts by weight of perfume were sprayed, to give a final powdery product of the high-bulk density detergent composition.

EXAMPLE 2

Similar composition and procedures to those in Example 1 were employed except for respectively changing the amounts of LIGHT ASH and sulfuric acid to 12.45 parts by weight and 0.57 parts by weight, to give a detergent composition. The fracture load of the granules obtained after the neutralization and granulation step was 742 gf, and the average particle size of the granules was 632 μm.

The resulting granules of the detergent composition, prior to the after-blending step, had percentage of particles with 1400 μm-pass: 82.6%; average particle size: 517 μm; bulk density: 730 g/L; free-flowability: 6.3 seconds; and hue: 91.4. Accordingly, the granules showed excellent properties.

Incidentally, the proportion of sulfuric acid to the LAS during neutralization reaction was such that the reaction mixture contained 0.23 mol of sulfuric acid per mol of the LAS. The amount of sodium carbonate was about five times the amount required for neutralizing the LAS and sulfuric acid.

EXAMPLE 3

Similar composition and procedures to those in Example 1 were employed except for respectively changing the amounts of LIGHT ASH and sulfuric acid to 12.33 parts by weight and 0.82 parts by weight, to give a detergent composition.

The resulting granules of the detergent composition, prior to the after-blending step, had percentage of particles with 1400 μm-pass: 83.8%; average particle size: 496 μm; bulk density: 717 g/L; free-flowability: 6.2 seconds; and hue: 91.5. Accordingly, the granules showed excellent properties.

Incidentally, the proportion of sulfuric acid to the LAS during neutralization reaction was such that the reaction mixture contained 0.3 mol of sulfuric acid per mol of the LAS. The amount of sodium carbonate was about four times the amount required for neutralizing the LAS and sulfuric acid.

EXAMPLE 4

Similar composition and procedures to those in Example 1 were employed except for respectively changing the amounts of LIGHT ASH, the LAS, and sulfuric acid to 11.11 parts by weight, 12.29 parts by weight, and 0.80 parts by weight, to give a detergent composition. Incidentally, the LAS mentioned above contained 0.18 parts by weight of sulfuric acid.

The resulting granules of the detergent composition, prior to the after-blending step, had percentage of particles with 1400 μm-pass: 70.0%; average particle size: 703 μm; bulk density: 694 g/L; free-flowability: 6.5 seconds; and hue: 91.0. Accordingly, the granules showed excellent properties.

Incidentally, the proportion of sulfuric acid to the LAS during neutralization reaction was such that the reaction mixture contained 0.27 mol of sulfuric acid per mol of the LAS. The amount of sodium carbonate was about four times the amount required for neutralizing the LAS and sulfuric acid.

EXAMPLE 5

The detergent composition having the composition shown in Table 1 was prepared in an amount of 35 kg for each unit using a high speed mixer "Lödige Mixer FKM-130D" (manufactured by Matsubo Co., Ltd.). This mixer was equipped with agitator blades and a shearing device, the shearing device corresponding to a chopper for disintegration and dispersion.

Here, the following procedures were carried out.

Powder Blending

The solid ingredients consisting of 20.06 parts by weight of sodium carbonate ("LIGHT ASH," manufactured by Central Glass Co., Ltd.; average particle size: 56.1 μm) were blended for one minute under the conditions of a rotational speed of agitator blades of 130 rpm and a rotational speed of shearing device of 2850 rpm by the Lödige Mixer.

Addition of Reaction Initiating Agent

Water was added to the contents in the mixer in an amount of 0.25 parts by weight as a reaction initiating agent, and the blending was carried out for one minute and thirty seconds under the same blending conditions as above.

Neutralization

While the mixer was operated under the same conditions as above, 10.92 parts by weight of a linear alkylbenzenesulfonic acid (LAS) and 0.82 parts by weight of 98% sulfuric acid, which were mixed in advance, were added to the contents in the mixer in four minutes. During the addition, the ingredients were cooled by allowing water to flow through the mixer jacket at 25° C. At this stage, the temperature rose to 81° C. at the highest. Incidentally, throughout this stage, the reaction mixture remained in a granular form. Incidentally, the LAS mentioned above contained 0.16 parts by weight of sulfuric acid. Also, the proportion of sulfuric acid to the LAS during neutralization reaction was such that the reaction mixture contained 0.3 mol of sulfuric acid per mol of the LAS. The amount of sodium carbonate was about seven times the amount required for neutralizing the LAS and sulfuric acid.

After the addition of the LAS, the mixer was continuously operated under the same conditions for one minute to complete the neutralization reaction and the granulation process.

The resulting granules of the detergent composition had percentage of particles with 1400 μm-pass: 81.0%; average particle size: 604 μm; bulk density: 707 g/L; free-flowability: 6.5 seconds; and hue: 91.1. Accordingly, the granules showed excellent properties.

EXAMPLE 6

Similar composition and procedures to those in Example 3 were employed except for not containing sodium tripolyphosphate at all and making zeolite as a main builder component, to give a detergent composition.

The resulting granules of the detergent composition, prior to the after-blending step, had percentage of particles with 1400 μm-pass: 83.9%; average particle size: 536 μm; bulk density: 737 g/L; free-flowability: 6.3 seconds; and hue: 90.2. Accordingly, the granules showed excellent properties.

EXAMPLE 7

Similar composition and procedures to those in Example 3 were employed except for using sodium tripolyphosphate having an average particle size of 58.4 μm, to give a detergent composition.

The resulting granules of the detergent composition, prior to the after-blending step, had percentage of particles with 1400 μm-pass: 82.3%; average particle size: 532 μm; bulk density: 760 g/L; free-flowability: 6.3 seconds; and hue: 90.8. Accordingly, the granules showed excellent properties.

COMPARATIVE EXAMPLE 1

The detergent composition having the composition shown in Table 2 was prepared in an amount of 35 kg for each unit using a high speed mixer "Lödige Mixer FKM-130D" (manufactured by Matsubo Co., Ltd.). This mixer was equipped with agitator blades and a shearing device, the shearing device corresponding to a chopper for disintegration and dispersion.

Here, the following procedures were carried out.

Powder Blendinq

The solid ingredients consisting of 7.0 parts by weight of sodium tripolyphosphate (STPP; average particle size: 11.2 μm), 12.69 parts by weight of sodium carbonate ("LIGHT ASH," manufactured by Central Glass Co., Ltd.; average particle size: 56.1 μm), and 0.11 parts by weight of a fluorescer were blended for one minute under the conditions of a rotational speed of agitator blades of 130 rpm and a rotational speed of shearing device of 2850 rpm by the Lödige Mixer.

Addition of Reaction Initiating Agent

Water was added to the contents in the mixer in an amount of 0.20 parts by weight as a reaction initiating agent, and the blending was carried out for one minute and thirty seconds under the same blending conditions as above.

Neutralization

While the mixer was operated under the same conditions as above, 10.92 parts by weight of a linear alkylbenzenesulfonic acid (LAS) were added to the contents in the mixer in four minutes. During the addition, the ingredients were cooled by allowing water to flow through the mixer jacket at 25° C. At this stage, the temperature rose to 73° C. at the highest. Incidentally, throughout this stage, the reaction mixture remained in a granular form. Incidentally, the LAS mentioned above contained 0.16 parts by weight of sulfuric acid. Also, the proportion of sulfuric acid to the LAS during neutralization reaction was such that the reaction mixture contained 0.05 mol of sulfuric acid per mol of the LAS.

After the addition of the LAS, the mixer was continuously operated under the same conditions for one minute to complete the neutralization reaction and the granulation process. The fracture load of the granules obtained in this Example was 1215 gf, and the average particle size of the granules was 1114 μm.

Addition of Liquid Ingredients and Surface Modification

At a point where the neutralization reaction and the granulation process were completed, an aqueous solution of a 40% by weight acrylic acid-maleic acid copolymer was added to the mixer with an effective amount of the copolymer being 0.18 parts by weight, while the mixer was operated under the same conditions as above, and the ingredients were mixed for one minute and thirty seconds. Thereafter, the resulting mixture was subjected to a surface modification treatment by adding 4.20 parts by weight of zeolite having an average particle size of 4 μm to the mixer as a surface modifier, and operating the mixer for additional two minutes. Incidentally, the zeolite contained 0.84 parts by weight of a crystal water.

The resulting granules of the detergent composition had percentage of particles with 1400 μm-pass: 67.4%; average particle size: 739 μm; bulk density: 830 g/L; free-flowability: 6.1 seconds; and hue: 91.6. Accordingly, the granules gave poorer results in the percentage of particles and in the average particle size than the granules of Examples.

After-Blending

Using a rotary mixer, 0.18 parts by weight of enzyme granules and the detergent composition obtained above were blended, and thereafter 0.07 parts by weight of perfume were sprayed, to give a final powdery product of the high-bulk density detergent composition.

Incidentally, the amount of sodium carbonate was about seven times the amount required for neutralizing the LAS and sulfuric acid.

COMPARATIVE EXAMPLE 2

The detergent composition having the composition shown in Table 2 was prepared in an amount of 35 kg for each unit using a high speed mixer "Lödige Mixer FKM-130D" (manufactured by Matsubo Co., Ltd.). This mixer was equipped with agitator blades and a shearing device, the shearing device corresponding to a chopper for disintegration and dispersion.

Here, the following procedures were carried out.

Powder Blending

The solid ingredients consisting of 7.0 parts by weight of sodium tripolyphosphate (STPP; average particle size: 11.2 μm), 11.53 parts by weight of sodium carbonate ("LIGHT ASH," manufactured by Central Glass Co., Ltd.; average particle size: 56.1 μm), 0.11 parts by weight of a fluorescer, and 1.16 parts by weight of sodium sulfate (prepared by pulverizing to an average particle size of 8.22 μm by a hammer mill) were blended for one minute under the conditions of a rotational speed of agitator blades of 130 rpm and a rotational speed of shearing device of 2850 rpm by the Lödige Mixer.

Addition of Reaction Initiating Agent

Water was added to the contents in the mixer in an amount of 0.20 parts by weight as a reaction initiating agent, and the blending was carried out for one minute and thirty seconds under the same blending conditions as above.

Neutralization

While the mixer was operated under the same conditions as above, 10.92 parts by weight of a linear alkylbenzenesulfonic acid (LAS) were added to the contents in the mixer in four minutes. During the addition, the ingredients were cooled by allowing water to flow through the mixer jacket at 25° C. At this stage, the temperature rose to 72° C. at the highest. Incidentally, throughout this stage, the reaction mixture remained in a granular form. Incidentally, the LAS mentioned above contained 0.16 parts by weight of sulfuric acid. Also, the proportion of sulfuric acid to the LAS during neutralization reaction was such that the reaction mixture contained 0.05 mol of sulfuric acid per mol of the LAS.

After the addition of the LAS, the mixer was continuously operated under the same conditions for one minute to complete the neutralization reaction and the granulation process.

Addition of Liquid Ingredients and Surface Modification

At a point where the neutralization reaction and the granulation process were completed, an aqueous solution of a 40% by weight acrylic acid-maleic acid copolymer was added to the mixer with an effective amount of the copolymer being 0.18 parts by weight, while the mixer was operated under the same conditions as above, and the ingredients were mixed for one minute and thirty seconds. Thereafter, the resulting mixture was subjected to a surface modification treatment by adding 4.20 parts by weight of zeolite having an average particle size of 4 μm to the mixer as a surface modifier, and operating the mixer for additional two minutes. Incidentally, the zeolite contained 0.84 parts by weight of a crystal water.

The resulting granules of the detergent composition had percentage of particles with 1400 μm-pass: 68.0%; average particle size: 720 μm; bulk density: 786 g/L; free-flowability: 6.3 seconds; and hue: 90.8. Accordingly, the granules gave poorer results in the percentage of particles and in the average particle size than the granules of Examples.

After-Blending

Using a rotary mixer, 0.18 parts by weight of enzyme granules and the detergent composition obtained above were blended, and thereafter 0.07 parts by weight of perfume were sprayed, to give a final powdery product of the high-bulk density detergent composition.

Incidentally, the amount of sodium carbonate was about seven times the amount required for neutralizing the LAS and sulfuric acid.

COMPARATIVE EXAMPLE 3

The detergent composition having the composition shown in Table 2 was prepared in an amount of 35 kg for each unit using a high speed mixer "Lödige Mixer FKM-130D" (manufactured by Matsubo Co., Ltd.). This mixer was equipped with agitator blades and a shearing device, the shearing device corresponding to a chopper for disintegration and dispersion.

Here, the following procedures were carried out.

Powder Blending

The solid ingredients consisting of 7.0 parts by weight of sodium tripolyphosphate (STPP; average particle size: 11.2 μm), 11.43 parts by weight of sodium carbonate ("LIGHT ASH," manufactured by Central Glass Co., Ltd.; average particle size: 56.1 μm), and 0.11 parts by weight of a fluorescer were blended for one minute under the conditions of a rotational speed of agitator blades of 130 rpm and a rotational speed of shearing device of 2850 rpm by the Lödige Mixer.

Addition of Reaction Initiating Agent

Water was added to the contents in the mixer in an amount of 0.20 parts by weight as a reaction initiating agent, and the blending was carried out for one minute and thirty seconds under the same blending conditions as above.

Neutralization

While the mixer was operated under the same conditions as above, 12.29 parts by weight of a linear alkylbenzenesulfonic acid (LAS) were added to the contents in the mixer in four minutes. During the addition, the ingredients were cooled by allowing water to flow through the mixer jacket at 25° C. At this stage, the temperature rose to 73° C. at the highest. Incidentally, throughout this stage, the reaction mixture remained in a granular form. Incidentally, the LAS mentioned above contained 0.18 parts by weight of sulfuric acid. Also, the proportion of sulfuric acid to the LAS during neutralization reaction was such that the reaction mixture contained 0.05 mol of sulfuric acid per mol of the LAS.

After the addition of the LAS, the mixer was continuously operated under the same conditions for one minute to complete the neutralization reaction and the granulation process.

Addition of Liquid Ingredients and Surface Modification

At a point where the neutralization reaction and the granulation process were completed, an aqueous solution of a 40% by weight acrylic acid-maleic acid copolymer was added to the mixer with an effective amount of the copolymer being 0.18 parts by weight, while the mixer was operated under the same conditions as above, and the ingredients were mixed for one minute and thirty seconds. Thereafter, the resulting mixture was subjected to a surface modification treatment by adding 4.20 parts by weight of zeolite having an average particle size of 4 μm to the mixer as a surface modifier, and operating the mixer for additional two minutes. Incidentally, the zeolite contained 0.84 parts by weight of a crystal water.

The resulting granules of the detergent composition had percentage of particles with 1400 μm-pass: 32.5%; average particle size: 1469 μm; bulk density: 736 g/L; free-flowability: 6.4 seconds; and hue: 91.4. Accordingly, the granules gave poorer results in the percentage of particles with a large proportion of coarse particles.

After-Blending

Using a rotary mixer, 0.18 parts by weight of enzyme granules and the detergent composition obtained above were blended, and thereafter 0.07 parts by weight of perfume were sprayed, to give a final powdery product of the high-bulk density detergent composition.

In this Comparative Example, the amount of sodium carbonate was about five times the amount required for neutralizing the LAS and sulfuric acid.

COMPARATIVE EXAMPLE 4

The detergent composition having the composition shown in Table 2 was prepared in an amount of 35 kg for each unit using a high speed mixer "Lödige Mixer FKM-130D" (manufactured by Matsubo Co., Ltd.). This mixer was equipped with agitator blades and a shearing device, the shearing device corresponding to a chopper for disintegration and dispersion.

Here, the following procedures were carried out.

Powder Blending

The solid ingredients consisting of 7.0 parts by weight of sodium tripolyphosphate (STPP; average particle size: 58.4 μm), 12.69 parts by weight of sodium carbonate ("LIGHT ASH," manufactured by Central Glass Co., Ltd.; average particle size: 56.1 μm), and 0.11 parts by weight of a fluorescer were blended for one minute under the conditions of a rotational speed of agitator blades of 130 rpm and a rotational speed of shearing device of 2850 rpm by the Lödige Mixer.

Addition of Reaction Initiating Agent

Water was added to the contents in the mixer in an amount of 0.20 parts by weight as a reaction initiating agent, and the blending was carried out for one minute and thirty seconds under the same blending conditions as above.

Neutralization

While the mixer was operated under the same conditions as above, 10.92 parts by weight of a linear alkylbenzenesulfonic acid (LAS) were added to the contents in the mixer in four minutes. During the addition, the ingredients were cooled by allowing water to flow through the mixer jacket at 25° C. At this stage, the temperature rose to 71° C. at the highest. Incidentally, throughout this stage, the reaction mixture remained in a granular form. Incidentally, the LAS mentioned above contained 0.16 parts by weight of sulfuric acid.

After the addition of the LAS, the mixer was continuously operated under the same conditions for one minute to complete the neutralization reaction and the granulation process.

Addition of Liquid Ingredients and Surface Modification

At a point where the neutralization reaction and the granulation process were completed, an aqueous solution of a 40% by weight acrylic acid-maleic acid copolymer was added to the mixer with an effective amount of the copolymer being 0.18 parts by weight, while the mixer was operated under the same conditions as above, and the ingredients were mixed for one minute and thirty seconds. Thereafter, the resulting mixture was subjected to a surface modification treatment by adding 4.20 parts by weight of zeolite having an average particle size of 4 μm to the mixer as a surface modifier, and operating the mixer for additional two minutes. Incidentally, the zeolite contained 0.84 parts by weight of a crystal water.

The resulting granules of the detergent composition had percentage of particles with 1400 μm-pass: 34.2%; average particle size: 1013 μm; bulk density: 712 g/L; and free-flowability: 7.8 seconds. Accordingly, the granules gave low bulk density and poor results in the percentage of particles with a large proportion in coarse particles.

After-Blending

Using a rotary mixer, 0.18 parts by weight of enzyme granules and the detergent composition obtained above were blended, and thereafter 0.07 parts by weight of perfume were sprayed, to give a final powdery product of the high-bulk density detergent composition.

Incidentally, the amount of sodium carbonate was about seven times the amount required for neutralizing the LAS and sulfuric acid.

Incidentally, Tables 1 and 2 show the compositions of the final powdery product of each of the detergent compositions in Examples and Comparative Examples. Also, Tables 3 and 4 show the properties of the detergent compositions after granulation.

TABLE 1

| Composition of Final Powdery Product of Detergent Composition | Examples | | | | | | |
|---|---|---|---|---|---|---|---|
| (% by weight) | 1 | 2 | 3 | 4 | 5 | 6 | 7 |
| LAS-Na | 32.00 | 32.00 | 32.00 | 36.00 | 32.00 | 32.00 | 32.00 |
| STPP | 20.00 | 20.00 | 20.00 | 20.00 | 0.00 | 0.00 | 20.00 |
| Zeolite | 12.00 | 12.00 | 12.00 | 12.00 | 12.00 | 32.00 | 12.00 |
| Sodium Carbonate | 29.90 | 28.40 | 27.30 | 23.20 | 49.40 | 27.80 | 27.30 |
| Sodium Sulfate | 1.60 | 3.00 | 4.00 | 4.00 | 4.00 | 4.00 | 4.00 |
| Acrylic Acid-Maleic Acid Copolymer | 0.50 | 0.50 | 0.50 | 0.50 | 0.00 | 0.50 | 0.50 |
| Fluorescent | 0.30 | 0.30 | 0.30 | 0.30 | 0.00 | 0.30 | 0.30 |
| Enzymes | 0.50 | 0.50 | 0.50 | 0.50 | 0.00 | 0.50 | 0.50 |
| Perfume | 0.20 | 0.20 | 0.20 | 0.20 | 0.00 | 0.20 | 0.20 |
| Water | 3.00 | 3.10 | 3.20 | 3.30 | 2.60 | 2.70 | 3.20 |

TABLE 2

| Composition of Final Powdery Product of Detergent Composition | Comparative Examples | | | |
|---|---|---|---|---|
| (% by weight) | 1 | 2 | 3 | 4 |
| LAS-Na | 32.00 | 32.00 | 36.00 | 32.00 |
| STPP | 20.00 | 20.00 | 20.00 | 20.00 |
| Zeolite | 12.00 | 12.00 | 12.00 | 12.00 |
| Sodium Carbonate | 30.82 | 27.50 | 26.54 | 30.82 |
| Sodium Sulfate | 0.68 | 4.00 | 0.76 | 0.68 |
| Acrylic Acid-Maleic Acid Copolymer | 0.50 | 0.50 | 0.50 | 0.50 |
| Fluorescent | 0.30 | 0.30 | 0.30 | 0.30 |
| Enzymes | 0.50 | 0.50 | 0.50 | 0.50 |
| Perfume | 0.20 | 0.20 | 0.20 | 0.20 |
| Water | 3.00 | 3.00 | 3.20 | 3.00 |

TABLE 3

| | Examples | | | | | | |
|---|---|---|---|---|---|---|---|
| | 1 | 2 | 3 | 4 | 5 | 6 | 7 |
| Average Particle Size (μm) of STPP | 11.2 | 11.2 | 11.2 | 11.2 | — | — | 58.4 |
| Average Particle Size (μm) of LIGHT ASH | 56.1 | 56.1 | 56.1 | 56.1 | 56.1 | 56.1 | 56.1 |
| Highest Powder Temp. (° C.) | 75 | 77 | 80 | 83 | 81 | 81 | 79 |
| Average Particle Size (μm) | 633 | 517 | 496 | 703 | 604 | 536 | 532 |
| Yield (Percentage of 1140 μm-pass Particles) (%) | 75.3 | 82.6 | 83.8 | 70.0 | 81.0 | 83.9 | 82.3 |

TABLE 3-continued

| | Examples | | | | | | |
|---|---|---|---|---|---|---|---|
| | 1 | 2 | 3 | 4 | 5 | 6 | 7 |
| Bulk Density (g/L) | 760 | 730 | 717 | 694 | 707 | 737 | 760 |
| Free Flowability (sec) | 6.2 | 6.3 | 6.2 | 6.5 | 6.5 | 6.3 | 6.3 |
| Hue (L value) | 92.44 | 91.4 | 91.5 | 91.0 | 91.1 | 90.2 | 90.8 |

TABLE 4

| | Comparative Examples | | | |
|---|---|---|---|---|
| | 1 | 2 | 3 | 4 |
| Average Particle Size (μm) of STPP | 11.2 | 11.2 | 11.2 | 58.4 |
| Average Particle Size (μm) of LIGHT ASH | 56.1 | 56.1 | 56.1 | 56.1 |
| Highest Powder Temp. (° C.) | 73 | 72 | 73 | 71 |
| Average Particle Size (μm) | 739 | 720 | 1469 | 1013 |
| Yield (Percentage of 1400 μm-pass Particles) (%) | 67.4 | 68.0 | 32.5 | 34.2 |
| Bulk Density (g/L) | 830 | 786 | 736 | 712 |
| Free Flowability (sec) | 6.1 | 6.3 | 6.4 | 7.8 |
| Hue (L value) | 91.6 | 90.8 | 91.4 | 91.8 |

As is clearly illustrated by the above results, by dry-neutralizing the components in the presence of a given amount of sulfuric acid, the high-bulk density detergent compositions having small particle sizes can be obtained at high yields (Examples 1 to 7). Also, as illustrated by Example 5 and Example 6, the method of the present invention can be suitably utilized to give desired effects without being limitative in the detergent compositions. Also, the method is particularly applicable for production of phosphorus-free detergents.

On the other hand, in the case of Comparative Example 1 where a smaller amount of sulfuric acid is used during neutralization, the granules are large, showing poorer results in the percentage of particles with 1400 μm-pass and in the average particle size as compared to Examples. Also, in the case of Comparative Example 2 where pulverized sodium sulfate is added, the resulting detergent granules have large particle size. By comparing Example 4 with Comparative Example 3, remarkable differences in the percentage of particles with 1400 μm-pass and in the average particle size can be noted when the concentration of the anionic surfactant (LAS-Na) in the resulting detergent composition is as high as 36.00% by weight. Therefore, the method of the present invention can be suitably applied in cases where the anionic surfactant is contained at a high concentration in the detergent composition. By comparing Example 7 and Comparative Example 4, even when the particle size of the tripolyphosphate is relatively large (58.4 μm), the effects of the method of the present invention can be clearly observed. Incidentally, in Example 1, Example 2, and Example 3, a decrease in the bulk densities can be observed by an increase in the amount of sulfuric acid, thereby suggesting that the bulk densities of the resulting detergent compositions can be controlled to desired values by the amount of sulfuric acid added. Incidentally, the detergent compositions obtained in each of Examples were subjected to X-ray diffraction analysis, but no diffraction peaks ascribed to sodium sulfate were detectable.

EXAMPLE 11

The detergent composition having the composition shown in Table 5 was prepared in an amount of 35 kg for each unit using a high speed mixer "Lödige Mixer FKM-130D" (manufactured by Matsubo Co., Ltd.). This mixer was equipped with agitator blades and a shearing device, the shearing device corresponding to a chopper for disintegration and dispersion.

Here, the following procedures were carried out.

Powder Blending

The solid ingredients consisting of 7.0 parts by weight of sodium tripolyphosphate (STPP; average particle size: 11.2 μm), 12.72 parts by weight of sodium carbonate ("LIGHT ASH," manufactured by Central Glass Co., Ltd.; average particle size: 56.1 μm), and 0.11 parts by weight of a fluorescer were blended for one minute under the conditions of a rotational speed of agitator blades of 130 rpm (peripheral speed: 3.4 m/s) and a rotational speed of shearing device of 2850 rpm (peripheral speed: 27 m/s) by the Lödige Mixer.

Addition of Reaction Initiating Agent

A 48% by weight aqueous NaOH solution was added to the contents in the mixer in an amount of 0.51 parts by weight as a reaction initiating agent, and the blending was carried out for one minute and thirty seconds under the same blending conditions as above.

Neutralization

While the mixer was operated under the same conditions as above, 10.19 parts by weight of a linear alkylbenzenesulfonic acid (LAS; molecular weight: 322) and 0.58 parts by weight of 98% sulfuric acid, which were mixed in advance, were added to the contents in the mixer in four minutes. During the addition, the ingredients were cooled by allowing water to flow through the mixer jacket at 25° C. Incidentally, throughout this stage, the reaction mixture remained in a granular form. Incidentally, the LAS mentioned above was prepared by $SO_3$ gas sulfonation method and contained 0.16 parts by weight of sulfuric acid. In other words, the resulting mixture contained 0.05 mol of sulfuric acid per mol of the LAS. Also, the proportion of sulfuric acid to the LAS during neutralization reaction was such that the reaction mixture contained 0.24 mol of sulfuric acid per mol of the LAS. The amount of sodium carbonate was about five times the amount required for neutralizing the LAS and sulfuric acid.

After the addition of the LAS, the mixer was continuously operated under the same conditions for three minutes to complete the neutralization reaction and the granulation process. Also, air was blown at a rate of 300 L/min immediately after the addition of the mixed acid.

Addition of Liquid Ingredients and Surface Modification

At a point where the neutralization reaction and the granulation process were completed, an aqueous solution of a 40% by weight acrylic acid-maleic acid copolymer was added to the mixer with an effective amount of the copolymer being 0.44 parts by weight, while the mixer was operated under the same conditions as above, and the ingredients were mixed for one minute and thirty seconds. Thereafter, the resulting mixture was subjected to a surface modification treatment by adding 4.20 parts by weight of zeolite having an average particle size of 4 μm to the mixer as a surface modifier, and operating the mixer for additional two minutes. Incidentally, the zeolite contained 0.84 parts by weight of a crystal water.

The resulting granules of the detergent composition had percentage of particles with 1400 μm-pass: 83.8%; average particle size: 469 μm; bulk density: 753 g/L; free-flowability: 6.3 seconds. Accordingly, the granules showed excellent properties.

After-Blending

Using a rotary mixer, 0.18 parts by weight of enzyme granules and the detergent composition obtained above were blended, and thereafter 0.07 parts by weight of perfume were sprayed, to give a final powdery product of the high-bulk density detergent composition.

EXAMPLES 12–22 AND COMPARATIVE EXAMPLES 11–19

Similar composition and procedures to those in Example 11 were employed except for using the starting materials listed in Tables 5 and 6 in amounts shown in the tables, to give each of the final powdery products of the high-bulk density detergent compositions. Here, in Examples 18 to 20, after completing given procedures for the neutralization process, additional components of fatty acid (having 14 to 18 carbon atoms) and a nonionic surfactant (having ethylene oxide moiety with 6 addition molar number) were added to the ingredients in the mixture in given amounts shown in Table 5, and the ingredients were blended for one minute. The composition and the properties of each of the resulting high-bulk density detergent compositions are listed in Tables 7 through 10.

Incidentally, the fracture load was measured by using a rheometer "NRA-3002D" (manufactured by Fudohkogyo K.K.).

TABLE 5

| Composition | Examples | | | | | | | | | | | |
|---|---|---|---|---|---|---|---|---|---|---|---|---|
| (parts by weight) | 11 | 12 | 13 | 14 | 15 | 16 | 17 | 18 | 19 | 20 | 21 | 22 |
| Powder Blending | | | | | | | | | | | | |
| STPP | 7.00 | 7.00 | 7.00 | 7.00 | 5.95 | 7.00 | 7.00 | 7.70 | 7.70 | — | — | 7.00 |
| Sodium Carbonate | 12.72 | 12.06 | 11.78 | 13.36 | 14.11 | 10.40 | 9.37 | 12.95 | 13.99 | 13.99 | 12.65 | 10.97 |
| Zeolite | — | — | — | — | — | — | — | — | — | 7.70 | 7.00 | — |
| Powdery Sodium Sulfate | — | — | — | — | — | — | — | — | — | — | — | 1.75 |
| Fluorescer | 0.11 | 0.11 | 0.11 | 0.11 | 0.11 | 0.11 | 0.11 | 0.11 | 0.11 | 0.11 | 0.11 | 0.11 |
| Addition of Reaction Initiating Agent | | | | | | | | | | | | |
| 48 wt %-Aqueous NaOH Solution | 0.51 | 0.51 | 0.51 | — | — | 0.61 | 0.66 | 0.37 | 0.27 | — | — | 0.51 |
| Neutralization | | | | | | | | | | | | |
| LAS | 10.19 | 10.19 | 10.19 | 10.19 | 10.19 | 12.22 | 13.24 | 7.47 | 5.43 | 5.43 | 10.19 | 10.19 |
| 98 wt % Sulfuric Acid | 0.58 | 1.82 | 2.31 | 0.58 | — | 1.29 | 1.40 | 0.87 | 0.90 | 0.90 | 1.08 | 0.58 |
| 85 wt % Phosphoric Acid | — | — | — | — | 0.74 | — | — | — | — | — | — | — |
| (Amount of Gas Blown) [L/min] | 300 | 300 | 300 | 300 | 300 | 300 | 300 | 300 | 300 | 300 | 300 | 300 |
| Fatty Acid | — | — | — | — | — | — | — | 0.49 | 0.49 | 0.49 | — | — |
| Nonionic Surfactant | — | — | — | — | — | — | — | 1.40 | 2.45 | 2.45 | — | — |
| Addition of Liquid Ingredients and Surface Modification | | | | | | | | | | | | |
| Acrylic Acid-Maleic Acid Copolymer | 0.44 | 0.44 | 0.44 | 0.44 | 0.44 | 0.44 | 0.44 | — | — | — | 0.44 | 0.44 |
| Zeolite | 4.20 | 4.20 | 4.20 | 4.20 | 4.20 | 4.20 | 4.20 | 4.20 | 4.20 | 4.20 | 4.20 | 4.20 |
| After-Blending | | | | | | | | | | | | |
| Enzyme | 0.18 | 0.18 | 0.18 | 0.18 | 0.18 | 0.18 | 0.18 | 0.18 | 0.18 | 0.18 | 0.18 | 0.18 |
| Perfume | 0.07 | 0.07 | 0.07 | 0.07 | 0.07 | 0.07 | 0.07 | 0.07 | 0.07 | 0.07 | 0.07 | 0.07 |
| Molar Ratio of Inorganic Acid/Liquid Acid Precursor [mol/mol] | 0.24 | 0.65 | 0.81 | 0.24 | 0.28 | 0.40 | 0.40 | 0.44 | 0.65 | 0.65 | 0.40 | 0.24 |

TABLE 6

| Composition | Comparative Examples | | | | | | | | |
|---|---|---|---|---|---|---|---|---|---|
| (parts by weight) | 11 | 12 | 13 | 14 | 15 | 16 | 17 | 18 | 19 |
| Powder Blending | | | | | | | | | |
| STPP | 7.00 | 7.00 | 7.00 | 7.00 | 7.00 | 7.70 | 7.70 | — | — |
| Sodium Carbonate | 13.05 | 13.68 | 12.20 | 11.06 | 10.10 | 13.26 | 14.34 | 14.34 | 13.22 |
| Zeolite | — | — | — | — | — | — | — | 7.70 | 7.70 |
| Powdery Sodium Sulfate | — | — | 0.90 | — | — | — | — | — | — |
| Fluorescer | 0.11 | 0.11 | 0.11 | 0.11 | 0.11 | 0.11 | 0.11 | 0.11 | 0.11 |

TABLE 6-continued

| Composition (parts by weight) | Comparative Examples 11 | 12 | 13 | 14 | 15 | 16 | 17 | 18 | 19 |
|---|---|---|---|---|---|---|---|---|---|
| Addition of Reaction Initiating Agent | | | | | | | | | |
| 48 wt %-Aqueous NaOH Solution | 0.51 | — | 0.51 | 0.61 | 0.66 | 0.37 | 0.27 | 0.27 | — |
| Neutralization | | | | | | | | | |
| LAS | 10.19 | 10.19 | 10.19 | 12.22 | 13.24 | 7.47 | 5.43 | 5.43 | 10.19 |
| 98 wt % Sulfuric Acid | — | — | — | — | — | — | — | — | — |
| 85 wt % Phosphoric Acid | — | — | — | — | — | — | — | — | — |
| (Amount of Gas Blown) [L/min] | 300 | 300 | 300 | 300 | 300 | 300 | 300 | 300 | 300 |
| Fatty Acid | — | — | — | — | — | 0.49 | 0.49 | 0.49 | — |
| Nonionic Surfactant | — | — | — | — | — | 1.40 | 2.45 | 2.45 | — |
| Addition of Liquid Ingredients and Surface Modification | | | | | | | | | |
| Acrylic Acid-Maleic Acid Copolymer | 0.44 | 0.44 | 0.44 | 0.44 | 0.44 | — | — | — | 0.44 |
| Zeolite | 4.20 | 4.20 | 4.20 | 4.20 | 4.20 | 4.20 | 4.20 | 4.20 | 4.20 |
| After-Blending | | | | | | | | | |
| Enzyme | 0.18 | 0.18 | 0.18 | 0.18 | 0.18 | 0.18 | 0.18 | 0.18 | 0.18 |
| Perfume | 0.07 | 0.07 | 0.07 | 0.07 | 0.07 | 0.07 | 0.07 | 0.07 | 0.07 |
| Molar Ratio of Inorganic Acid/Liquid Acid Precursor [mol/mol] | 0.04 | 0.04 | 0.04 | 0.04 | 0.04 | 0.04 | 0.03 | 0.03 | 0.04 |

TABLE 7

| Properties | Examples 11 | 12 | 13 | 14 | 15 | 16 | 17 | 18 | 19 | 20 | 21 | 22 |
|---|---|---|---|---|---|---|---|---|---|---|---|---|
| After Neutralization and Granulation Process | | | | | | | | | | | | |
| Powder Temp. [° C.] | 80.1 | 87.3 | 92.3 | 79.2 | 73.7 | 84.3 | 90.0 | 79.4 | 72.0 | 68.8 | 80.8 | 79.5 |
| Fracture Load [gf] | 673 | 520 | 470 | 690 | 930 | 850 | 950 | 226 | 57 | 51 | 502 | 659 |
| Average Particle Size [μm] | 560 | 488 | 450 | 583 | 570 | 850 | 1785 | 290 | 241 | 339 | 580 | 545 |
| After Surface Modification Process | | | | | | | | | | | | |
| Powder Temp. [° C.] | 69.5 | 71.1 | 74.5 | 68.1 | 64.2 | 70.9 | 75.4 | 66.5 | 63.2 | 58.5 | 61.0 | 68.2 |
| Average Particle Size [μm] | 469 | 400 | 380 | 490 | 470 | 670 | 1567 | 493 | 445 | 494 | 450 | 458 |
| Yield [%] | 83.8 | 86.0 | 87.0 | 83.1 | 79.2 | 73.0 | 30.0 | 87.9 | 78.9 | 78.8 | 79.1 | 84.0 |
| Bulk Density [g/L] | 753 | 723 | 724 | 731 | 816 | 725 | 719 | 791 | 831 | 818 | 747 | 748 |
| Free Flowability [sec] | 6.3 | 6.6 | 6.8 | 6.4 | 6.1 | 6.4 | 6.8 | 6.0 | 6.1 | 6.6 | 6.8 | 6.5 |

TABLE 8

| Properties | Comparative Examples 11 | 12 | 13 | 14 | 15 | 16 | 17 | 18 | 19 |
|---|---|---|---|---|---|---|---|---|---|
| After Neutralization and Granulation Process | | | | | | | | | |
| Powder Temp. [° C.] | 73.0 | 68.9 | 73.1 | 76.8 | ※ | 68.1 | 60.1 | 56.7 | 67.8 |
| Fracture Load [gf] | 1124 | 1163 | 1100 | 1606 | ※ | 723 | 130 | 147 | 948 |
| Average Particle Size [μm] | 879 | 970 | 940 | 3055 | ※ | 390 | 299 | 463 | 750 |
| After Surface Modification Process | | | | | | | | | |
| Powder Temp. [° C.] | 64.5 | 62.6 | 62.1 | 63.5 | ※ | 58.5 | 55.1 | 54.3 | 55.4 |
| Average Particle Size [μm] | 670 | 710 | 720 | 2033 | ※ | 1313 | 1173 | 964 | 590 |
| Yield [%] | 69.8 | 63.7 | 65.0 | 12.0 | ※ | 53.2 | 32.9 | 57.4 | 76.3 |

TABLE 8-continued

| Properties | Comparative Examples 11 | 12 | 13 | 14 | 15 | 16 | 17 | 18 | 19 |
|---|---|---|---|---|---|---|---|---|---|
| Bulk Density [g/L] | 841 | 788 | 831 | 692 | ※ | 847 | 864 | 848 | 769 |
| Free Flowability [sec] | 6.2 | 6.4 | 6.3 | 8.7 | ※ | 6.1 | 6.6 | 6.9 | 6.9 |

Remarks
※: The neutralized product became highly sticky, and thus no measurements could be taken.

TABLE 9

| (parts by weight) | Examples 11 | 12 | 13 | 14 | 15 | 16 | 17 | 18 | 19 | 20 | 21 | 22 |
|---|---|---|---|---|---|---|---|---|---|---|---|---|
| Las-Na | 30.00 | 30.00 | 30.00 | 30.00 | 30.00 | 36.00 | 39.00 | 22.00 | 16.00 | 16.00 | 30.00 | 30.00 |
| Soap | 0.00 | 0.00 | 0.00 | 0.00 | 0.00 | 0.00 | 0.00 | 1.50 | 1.50 | 1.50 | 0.00 | 0.00 |
| STPP | 20.00 | 20.00 | 20.00 | 20.00 | 17.00 | 20.00 | 20.00 | 22.00 | 22.00 | 0.00 | 0.00 | 20.00 |
| Zeolite | 12.00 | 12.00 | 12.00 | 12.00 | 12.00 | 12.00 | 12.00 | 12.00 | 12.00 | 34.00 | 32.00 | 12.00 |
| Sodium Carbonate | 30.40 | 24.80 | 22.50 | 31.30 | 32.30 | 20.80 | 17.10 | 31.30 | 35.00 | 35.00 | 28.70 | 25.40 |
| Sodium Sulfate* | 3.00 | 8.00 | 10.00 | 3.00 | 0.50 | 6.00 | 6.50 | 4.00 | 4.00 | 4.00 | 5.00 | 8.00 |
| Sodium Phosphate | 0.00 | 0.00 | 0.00 | 0.00 | 3.00 | 0.00 | 0.00 | 0.00 | 0.00 | 0.00 | 0.00 | 0.00 |
| Acrylic Acid-Maleic Acid Copolymer | 0.50 | 0.50 | 0.50 | 0.50 | 0.50 | 0.50 | 0.50 | 0.00 | 0.00 | 0.00 | 0.50 | 0.50 |
| Nonionic Surfactant | 0.00 | 0.00 | 0.00 | 0.00 | 0.00 | 0.00 | 0.00 | 4.00 | 7.00 | 7.00 | 0.00 | 0.00 |
| Fluorescer | 0.30 | 0.30 | 0.30 | 0.30 | 0.30 | 0.30 | 0.30 | 0.30 | 0.30 | 0.30 | 0.30 | 0.30 |
| Enzyme | 0.50 | 0.50 | 0.50 | 0.50 | 0.50 | 0.50 | 0.50 | 0.50 | 0.50 | 0.50 | 0.50 | 0.50 |
| Perfume | 0.20 | 0.20 | 0.20 | 0.20 | 0.20 | 0.20 | 0.20 | 0.20 | 0.20 | 0.20 | 0.20 | 0.20 |
| Water | 3.10 | 3.70 | 4.00 | 2.20 | 3.70 | 3.70 | 3.90 | 2.20 | 1.50 | 1.50 | 2.80 | 3.10 |
| Sodium Sulfate** | 3.14 | 8.43 | 11.14 | n.t. | n.t. | 6.14 | 6.57 | 4.55 | n.t. | n.t. | 5.43 | n.t. |

Remarks
*: Amount calculated from starting material composition.
**: Amount chemically determined by ion chromatography.
n.t.: Not tested.

TABLE 10

| (parts by weight) | Comparative Examples 11 | 12 | 13 | 14 | 15 | 16 | 17 | 18 | 19 |
|---|---|---|---|---|---|---|---|---|---|
| Las-Na | 30.00 | 30.00 | 30.00 | 36.00 | 39.00 | 22.00 | 16.00 | 16.00 | 30.00 |
| Soap | 0.00 | 0.00 | 0.00 | 0.00 | 0.00 | 1.50 | 1.50 | 1.50 | 0.00 |
| STPP | 20.00 | 20.00 | 20.00 | 20.00 | 20.00 | 22.00 | 22.00 | 0.00 | 0.00 |
| Zeolite | 12.00 | 12.00 | 12.00 | 12.00 | 12.00 | 12.00 | 12.00 | 34.00 | 32.00 |
| Sodium Carbonate | 33.20 | 34.10 | 30.20 | 26.75 | 23.60 | 34.80 | 38.65 | 38.65 | 33.70 |
| Sodium Sulfate* | 0.50 | 0.50 | 3.00 | 0.55 | 0.60 | 0.50 | 0.45 | 0.45 | 0.50 |
| Acrylic Acid-Maleic Acid Copolymer | 0.50 | 0.50 | 0.50 | 0.50 | 0.50 | 0.00 | 0.00 | 0.00 | 0.50 |
| Nonionic Surfactant | 0.00 | 0.00 | 0.50 | 0.00 | 0.00 | 4.00 | 7.00 | 7.00 | 0.00 |
| Fluorescer | 0.30 | 0.30 | 0.30 | 0.30 | 0.30 | 0.30 | 0.30 | 0.30 | 0.30 |
| Enzyme | 0.50 | 0.50 | 0.50 | 0.50 | 0.50 | 0.50 | 0.50 | 0.50 | 0.50 |
| Perfume | 0.20 | 0.20 | 0.20 | 0.20 | 0.20 | 0.20 | 0.20 | 0.20 | 0.20 |
| Water | 2.80 | 1.90 | 2.80 | 3.20 | 3.30 | 2.20 | 1.40 | 1.40 | 2.30 |
| Sodium Sulfate** | 0.54 | n.t. | n.t. | n.t. | n.t. | 0.34 | n.t. | n.t. | 0.50 |

Remarks
*: Amount calculated from starting material composition.
**: Amount chemically determined by ion chromatography.
n.t.: Not tested.

As is clear from the results in Tables 5 to 10, by dry-neutralizing the liquid acid precursor in the presence of a given amount of an inorganic acid, high-bulk density detergent compositions comprising granules with small particle sizes can be obtained at high yields in Examples 11 to 22. Also, as is clear from Examples 18 to 21, according to the method of the present invention, the desired effects can be exhibited without being limited to the detergent compositions, and the method is particularly suitably applicable in the production of phosphorus-free detergents. Particularly in the case of Examples 11 to 13, it is found that as the molar ratio of the inorganic acid to the liquid acid precursor increases, the particle size of the resulting detergent granules become smaller, so that the detergent granules with a desired particle size can be obtained by controlling the above molar ratio.

On the other hand, in the case of Comparative Example 11 where the amount of the inorganic acid at neutralization is small, the resulting granules are large, having lower percentages of particles with 1400 $\mu$m-pass and larger average particle size. Also, in the case of Comparative Example 13 where pulverized sodium sulfate is added, the resulting detergent granules have large particle sizes, so that similar effects to those attained by addition of sulfuric acid cannot be obtained.

By comparing the results of Example 16 with those of Comparative Example 14 and the results of Example 17 with those of Comparative Example 15, even more remarkable differences in the percentages of particles with 1400 μm-pass and the average particle sizes can be observed in cases where the anionic surfactant (LAS-Na) is contained in the resulting detergent composition in high concentrations. Therefore, the method of the present invention is suitably applicable in cases where the concentrations of the anionic surfactant in the detergent composition are high.

Also, when comparing the results of Example 18 with those of Comparative Example 16, in the case where the concentration of the anionic surfactant (LAS-Na) is low, the microporous surface areas of the detergent composition increase by addition of the inorganic acid, so that large amounts of the liquid starting material, such as nonionic surfactants, can be formulated while maintaining a small particle size in the detergent granules.

Also, the detergent compositions obtained in each of Examples 11 to 21 are subjected to X-ray diffraction analysis, but no diffraction peaks ascribed to inorganic salts, such as sodium sulfate, are detectable.

INDUSTRIAL APPLICABILITY

By neutralizing the liquid acid precursor of a non-soap, anionic surfactant with a water-soluble, solid, alkali inorganic substance in the presence of a given amount of the organic acid, high-bulk density detergent compositions comprising granules having small particle sizes can be obtained at high yields.

The invention claimed is:

1. A method for producing detergent granules, comprising the step of dry-neutralizing a liquid acid precursor of a non-soap, anionic surfactant prepared by a $SO_3$ gas sulfonation method, with a water-soluble, solid, alkali inorganic substance, wherein a dry-neutralizing step is carried out in the presence of 0.1 to 1.0 mole of a sulfuric acid per mole of said liquid acid precursor of a non-soap, anionic surfactant;

wherein the amount of sulfuric acid preexisting in the liquid acid precursor of a non-soap, anionic surfactant is 0.05 mole or less per mole of said liquid acid precursor;

wherein the sulfuric acid and the liquid acid precursor of a non-soap, anionic surfactant are added separately to the starting material components; and wherein the resulting detergent granules contain the non-soap, anionic surfactant in an amount of 28% by weight or more and less than 50% by weight, and have a molar ratio of (inorganic salt undetectable by x-ray diffraction method)/(non-soap, anionic surfactant) of from 0.1 to 1.0, and the inorganic salt undetectable by x-ray diffraction method is sodium sulfate.

2. A method for producing detergent granules, comprising the step of dry-neutralizing a liquid acid precursor of a non-soap, anionic surfactant prepared by a $SO_3$ gas sulfonation method, with a water-soluble, solid, alkali inorganic substance, wherein a dry-neutralizing step is carried out in the presence of 0.3 to 1.0 mole of a sulfuric acid per mole of said liquid acid precursor of a non-soap, anionic surfactant;

wherein the amount of sulfuric acid preexisting in the liquid acid precursor of a non-soap, anionic surfactant is 0.05 mole or less per mole of said liquid acid precursor;

wherein the sulfuric acid and the liquid acid precursor of a non-soap, anionic surfactant are added separately to the starting material components; and wherein the resulting detergent granules contain the non-soap, anionic surfactant in an amount of 10% by weight or more and less than 28% by weight, and have a molar ratio of (inorganic salt undetectable by x-ray diffraction method)/(non-soap, anionic surfactant) of from 0.3 to 1.0, and the inorganic salt undetectable by x-ray diffraction method is sodium sulfate.

3. The method according to claim 1 or 2, further comprising the step of adding a free-flowing aid after the dry-neutralizing step, to surface modify the detergent granules.

4. The method according to claim 1 or 2, further comprising the step of adding a liquid component after the dry-neutralizing step.

5. The method according to claim 4, further comprising the step of adding a free-flowing aid after the step of adding a liquid component, to surface-modify the detergent granules.

6. The method according to claim 1 or 2, wherein said liquid acid precursor of a non-soap, anionic surfactant is a linear alkylbenzenesulfonic acid obtained by a $SO_3$ gas sulfonation method.

7. The method according to claim 1, wherein the dry-neutralizing step is carried out in the presence of 0.3 to 0.8 mole of said sulfuric acid per mold mole of said liquid acid precursor of a non-soap, anionic surfactant.

8. The method according to claim 1, wherein the dry-neutralizing step is carried out in the presence of 0.35 to 0.7 mole of said sulfuric acid per mole of said liquid acid precursor of a non-soap, anionic surfactant.

9. The method according to claim 2, wherein the dry-neutralizing step is carried out in the presence of 0.3 to 0.8 mole of said sulfuric acid per mole of said liquid acid precursor of a non-soap, anionic surfactant.

10. The method according to claim 2, wherein the dry-neutralizing step is carried out in the presence of 0.35 to 0.7 mole of said sulfuric acid per mole of said liquid acid precursor of a non-soap, anionic surfactant.

* * * * *